US012377945B1

(12) United States Patent
Powers

(10) Patent No.: US 12,377,945 B1
(45) Date of Patent: Aug. 5, 2025

(54) MARINE PROPELLERS WITH COMPRESSION SPRING SLEEVE ASSEMBLIES

(71) Applicant: Charles S. Powers, Shreveport, LA (US)

(72) Inventor: Charles S. Powers, Shreveport, LA (US)

( * ) Notice: Subject to any disclaimer, the term of this patent is extended or adjusted under 35 U.S.C. 154(b) by 7 days.

(21) Appl. No.: 18/123,717

(22) Filed: Mar. 20, 2023

Related U.S. Application Data

(60) Provisional application No. 63/322,010, filed on Mar. 21, 2022.

(51) Int. Cl.
*B63H 1/20* (2006.01)
*B63H 1/15* (2006.01)
*B63H 23/34* (2006.01)

(52) U.S. Cl.
CPC ..... *B63H 1/20* (2013.01); *B63H 1/15* (2013.01); *B63H 2023/342* (2013.01)

(58) Field of Classification Search
CPC ..... B63H 1/15; B63H 1/20; B63H 2023/342; B63H 23/34; B63H 21/30
USPC ..... 440/52
See application file for complete search history.

(56) References Cited

U.S. PATENT DOCUMENTS 2,326,450 A 8/1943 Fawick
2,848,883 A 8/1958 Dalfolio
3,260,044 A 7/1966 Garraway
4,086,012 A 4/1978 Buckley
4,344,306 A 8/1982 Citron
4,389,203 A 6/1983 Duntzen
4,452,591 A 6/1984 Fishbaugh
4,566,855 A 1/1986 Costable
4,750,685 A 6/1988 Frei
5,252,028 A 10/1993 LoBosco
6,478,543 B1 * 11/2002 Tuchscherer ..... B63H 23/34 416/134 R
6,773,232 B2 8/2004 Powers
7,086,836 B1 8/2006 Sheth
7,223,073 B2 5/2007 Dean
7,488,225 B2 2/2009 Lin
7,578,744 B2 8/2009 Park
7,883,422 B2 2/2011 Takamura
(Continued)

*Primary Examiner* — Christopher Verdier
(74) *Attorney, Agent, or Firm* — R. Keith Harrison

(57) ABSTRACT

Marine propellers with compression spring sleeve assemblies for driving engagement by a propeller drive shaft may include a propeller hub having an axis of rotation. A compression spring sleeve assembly may be disposed in the propeller hub. The compression spring sleeve assembly may include a drive core comprising a drive core wall. At least one drive rib may extend from the drive core wall. A shaft bore may be formed by the drive core wall. The shaft bore may be sized and configured to receive the propeller drive shaft for driving rotational engagement by the propeller drive shaft. A drive sleeve may be drivingly engaged for rotation by the drive core and drivingly engage the propeller hub for rotation. The drive sleeve may have a drive sleeve body. At least one axial deformation element may have at least one deformation passageway in the drive sleeve body of the drive sleeve. The axial deformation element or elements may be oriented substantially parallel to the axis of rotation of the propeller hub and substantially encased by the drive sleeve body.

31 Claims, 19 Drawing Sheets

(56) References Cited

U.S. PATENT DOCUMENTS

| | | | | |
|---|---|---|---|---|
| 8,277,269 | B1 | 10/2012 | Alby | |
| 10,336,418 | B2 | 7/2019 | Kuroki | |
| 10,533,615 | B1 | 1/2020 | Powers | |
| 11,745,842 | B1 * | 9/2023 | Powers | B63H 1/20 440/49 |
| 11,760,460 | B1 * | 9/2023 | Powers | B63H 23/34 416/134 R |
| 2005/0186861 | A1 | 8/2005 | Powers | |

* cited by examiner

MARINE PROPELLERS WITH COMPRESSION SPRING SLEEVE ASSEMBLIES

CROSS-REFERENCE TO RELATED APPLICATIONS

This application claims the benefit of U.S. provisional application No. 63/322,010, filed Mar. 21, 2022, and entitled MARINE PROPELLERS WITH COMPRESSION SPRING SLEEVE ASSEMBLIES, which provisional application is hereby incorporated by reference herein in its entirety.

FIELD

Illustrative embodiments of the disclosure relate to marine propellers. More particularly, illustrative embodiments of the disclosure relate to marine propellers having compression spring sleeve assemblies which may couple a marine propeller to a propeller drive shaft to transmit torsional drive forces from the drive shaft to the propeller and have at least one axial deformation element which provides engineered deformation, spring return and/or shearability characteristics or properties for optimum driveline performance and protection.

SUMMARY

Illustrative embodiments of the disclosure are generally directed to marine propellers with compression spring sleeve assemblies for driving engagement by a propeller drive shaft. An illustrative embodiment of the marine propellers with compression spring sleeve assemblies may include a propeller hub having an axis of rotation. A compression spring sleeve assembly may be disposed in the propeller hub. The compression spring sleeve assembly may include a drive core comprising a drive core wall. At least one drive rib may extend from the drive core wall. A shaft bore may be formed by the drive core wall. The shaft bore may be sized and configured to receive the propeller drive shaft for driving rotational engagement by the propeller drive shaft. A drive sleeve may be drivingly engaged for rotation by the drive core. The drive sleeve may drivingly engage the propeller hub for rotation. The drive sleeve may have a drive sleeve body. At least one axial deformation element may be provided in the drive sleeve body of the drive sleeve. The at least one axial deformation element may have at least one deformation passageway. The axial deformation element or elements may be oriented substantially parallel to the axis of rotation of the propeller hub and may be substantially encased by the drive sleeve body.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
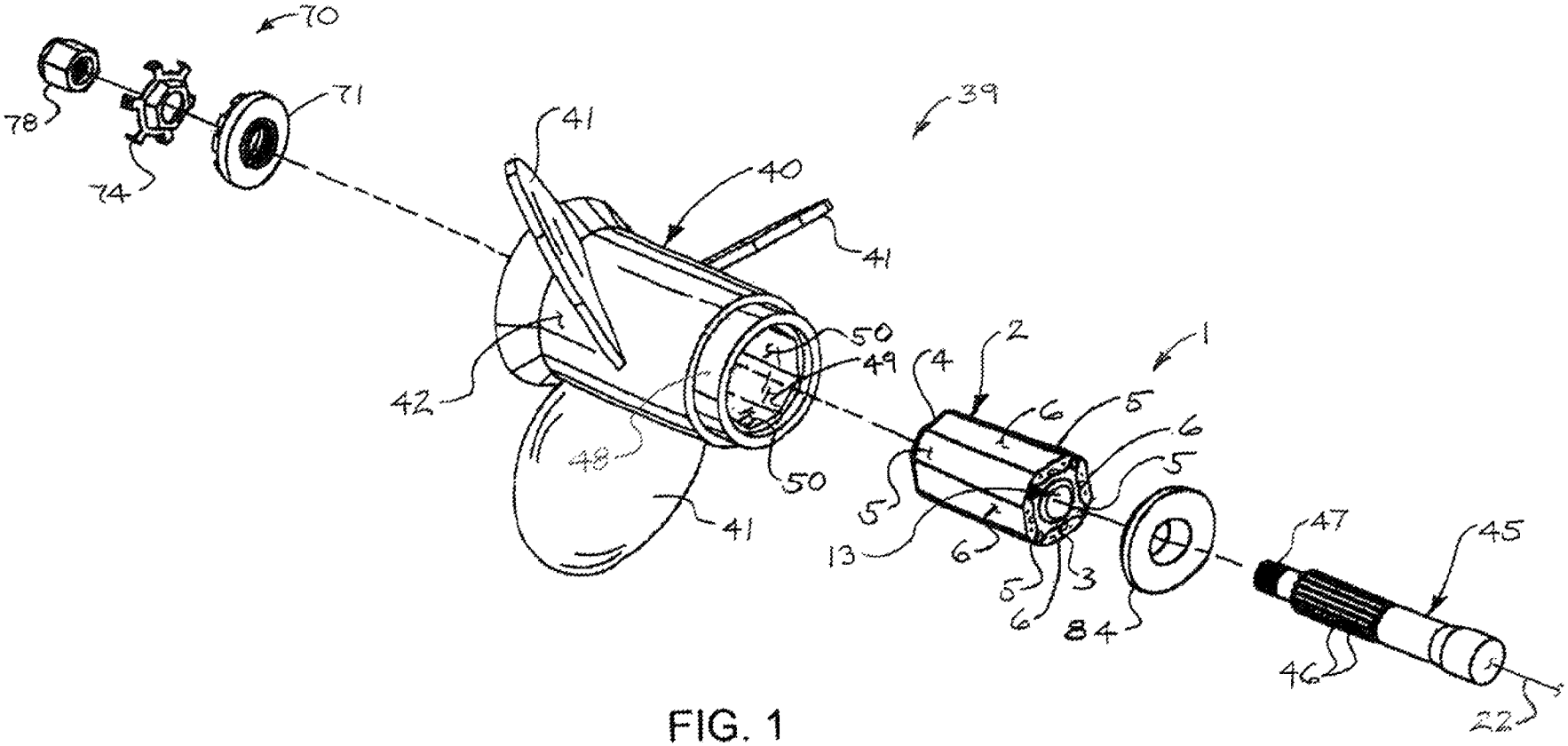
FIG. 1 is an exploded front perspective view of an illustrative embodiment of the marine propellers with compression spring sleeve assemblies.
Figure 2:
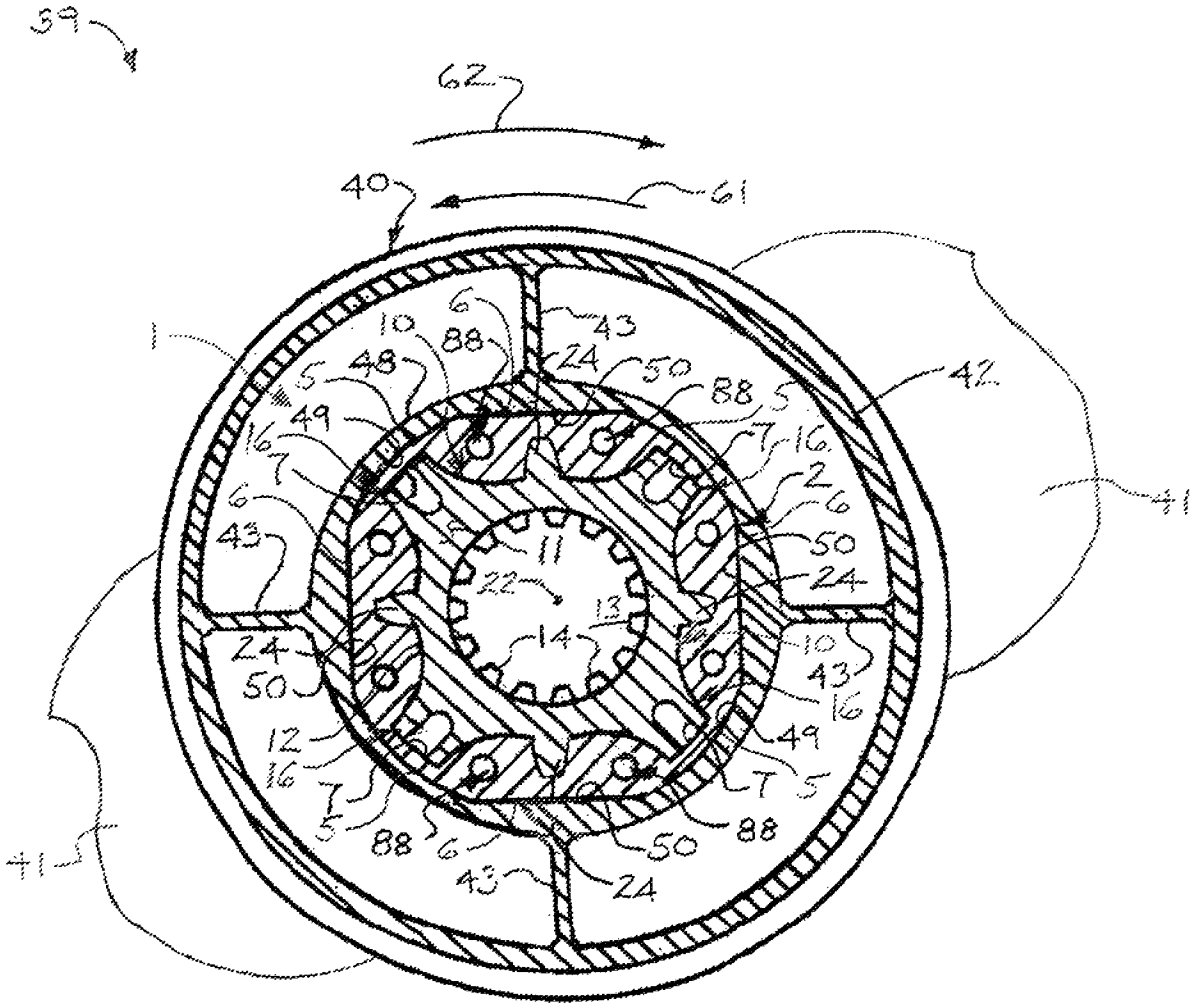
FIG. 2 is a cross-sectional view of the propeller hub of the assembled marine propeller illustrated in FIG. 1, with the compression spring sleeve assembly deployed in place in the propeller hub and illustrating forward and reverse rotational directions of the marine propeller in typical application of the marine propellers with compression spring sleeve assemblies.

Referring initially to FIGS. 1-28 of the drawings, an illustrative embodiment of the marine propellers with compression spring sleeve assemblies of the disclosure is generally indicated by reference numeral 39 in FIGS. 1 and 2. The marine propeller with compression spring sleeve assembly 39, hereinafter marine propeller assembly 39, may include a compression spring sleeve assembly 1. In some applications, the compression spring sleeve assembly 1 may drivingly couple a marine or boat propeller 40, having propeller blades 41 extending from a propeller hub 42, to a propeller drive shaft 45, typically provided with drive shaft splines 46 and drive shaft threads 47 and drivingly engaged by an outboard boat motor on a marine vehicle (not illustrated). Accordingly, in typical operation of the marine propeller assembly 39, the propeller drive shaft 45 may rotate the propeller hub 42 of the marine propeller 40 about a central axis of rotation 22 (FIGS. 1 and 2). The compression spring sleeve assembly 1 may be configured to transmit forward and reverse torsional forces from the propeller drive shaft 45 to the marine propeller 40 in operation of the outboard motor. The compression spring sleeve assembly 1 may couple a drive to an output in any of a variety of other applications.

As illustrated in FIG. 2, a central propeller hub drive sleeve 48 may be disposed in the propeller hub 42 of the marine propeller 40. Multiple hub vanes 43 may extend between the propeller hub drive sleeve 48 and the propeller hub 42. In some embodiments, the propeller hub drive sleeve 48 of the marine propeller 40 may be wedge-shaped and may gradually narrow or taper from the aft end to the fore end of the propeller hub 42. In other embodiments, the propeller hub drive sleeve 48 may be non-tapered and uniform in width from the aft end to the fore end of the propeller hub 42. The interior surface of the propeller hub drive sleeve 48 may include alternating, concave lug slots 49 and planar hub drive sleeve flats 50 which may extend along at least a portion of the length of the propeller hub drive sleeve 48 for purposes which will be hereinafter described.

As will be hereinafter further described, the compression spring sleeve assembly 1 may provide a forward or reverse torsional drive force from the propeller drive shaft 45 to the propeller hub 42 while imparting shear capability between those components to prevent or minimize damage to the propeller drive system during power surges and loads typically in the event that one of the propeller blades 41 of the rotating marine propeller 40 inadvertently strikes a submerged object (not illustrated) in operation of the marine vehicle on a water body. The compression spring sleeve assembly 1 may additionally eliminate or reduce deadband or "play" between the propeller 40 and the propeller drive shaft 45 upon termination of torque applied to the propeller drive shaft 45, as well as attenuate or dampen torsional forces transmitted from the propeller drive shaft 45 to the marine propeller 40 to reduce shock and impact sounds and absorb vibration during gear changing or propeller striking events. The compression spring sleeve assembly 1, either independently or in conjunction with other deformation modification features which will be hereinafter described, may provide multiple options to soften, harden or stiffen the interplay between and alter the spring return characteristics of the marine propeller 40 relative to the propeller drive shaft 45.

As illustrated in FIGS. 1-28, in some embodiments, the compression spring sleeve assembly 1 may have a monolithic construction and may include a drive sleeve 2. As illustrated in FIGS. 5-10, the drive sleeve 2 may have a drive sleeve body 8 which may be elongated with a fore sleeve end 3 and an aft sleeve end 4. Sleeve lugs 5 and sleeve flats 6 may be formed or shaped in the exterior surface of the drive sleeve body 8 in alternating relationship to each other according to the knowledge of those skilled in the art. As illustrated in FIG. 2, in the assembled compression spring sleeve assembly 1, the exterior sleeve lugs 5 and sleeve flats 6 on the drive sleeve 2 may engage the respective companion lug slots 49 and hub drive sleeve flats 50 in the interior surface of the propeller hub drive sleeve 48.

Figure 26:
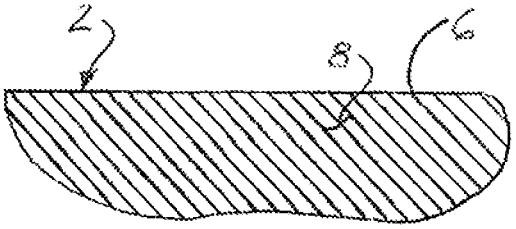
FIG. 26 is an enlarged sectional view, taken at section line 26 in FIG. 21, of a portion of the drive sleeve body of the drive sleeve of a compression spring sleeve assembly according to some embodiments of the marine propellers with compression spring sleeve assemblies, with the drive sleeve body matrix of the drive sleeve body having a uniform construction.
Figure 27:
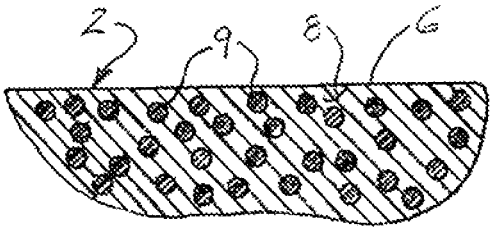
FIG. 27 is an enlarged sectional view, also taken at section line 26 in FIG. 21, illustrating reinforcing members extending throughout a drive sleeve body matrix of the drive sleeve according to some embodiments of the marine propellers with compression spring sleeve assemblies.

The drive sleeve body 8 of the drive sleeve 2 may include at least one elastomeric material such as rubber, for example and without limitation. As illustrated in FIG. 26, in some embodiments, the drive sleeve body 8 may have a uniform matrix construction with a single material having the same shore hardness, deformability, modulus of elasticity, shearability, density, spring return, and/or other resiliency characteristics or properties (physical properties) throughout. As illustrated in FIG. 27, in some embodiments, the drive sleeve body 8 may have a matrix of rubber or other elastomeric material with reinforcing members 9 extending throughout the matrix. The reinforcing members 9 may have deformation characteristics or properties which differ from those of the material which forms the matrix of the drive sleeve body 8 to vary the deformation, shearability, density, and/or spring return characteristics of the drive sleeve 2.

Figure 6:
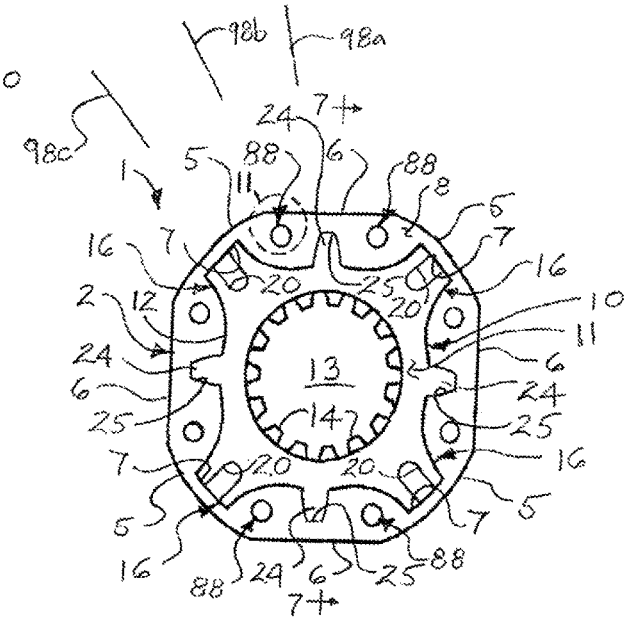
FIG. 6 is a front view of the illustrative compression spring sleeve assembly illustrated in FIG. 5.

At least one rib slot 7 may extend into the interior surface of the drive sleeve 2 for purposes which will be hereinafter described. The rib slot 7 may extend along at least a portion of the length of the compression spring sleeve assembly 1. As illustrated in FIG. 6, in some embodiments, the rib slots 7 may centrally align or register with the respective sleeve lugs 5 on the exterior surface of the drive sleeve 2. In some embodiments, the rib slots 7 may align or register with the respective sleeve flats 6 on the exterior surface of the drive sleeve 2.

A drive core 10 may be disposed in the drive sleeve 2 of the compression spring sleeve assembly 1. The drive core 10 may include a drive core wall 11. The drive core wall 11 may extend at least a portion of, and typically, the entire length of the drive sleeve 2. The drive core wall 11 may include at least one hard and/or rigid material such as metal and/or composite. For example and without limitation, in some embodiments, the drive core wall 11 may include at least one metal such as stainless steel, aluminum alloy, bronze or combinations thereof.

Figure 3:
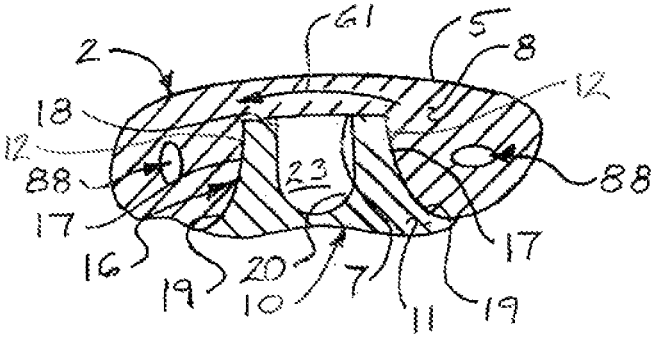
FIG. 3 is an enlarged sectional view of a drive rib on the drive core engaging a companion rib slot in the drive sleeve with the drive core rotating the drive sleeve in the forward rotational direction, more particularly illustrating typical radial deformation of an axial deformation element on the driving side of the drive rib and transverse deformation of the axial deformation element on the trailing side of the drive rib.

As illustrated in FIG. 3, the interior surface of the drive sleeve 2 may join or engage the exterior surface of the drive core 10 at a sleeve/core interface 12. The attachment between the drive sleeve 2 and the drive core 10 at the sleeve/core interface 12 may utilize any of a variety of techniques or a combination of techniques for the purpose. For example and without limitation, the attachment may be facilitated through vulcanization, adhesive bonding, mechanical attachment using ribbed or raised keys and shoulders, or any combination thereof, typically as will be hereinafter described.

As illustrated in FIGS. 5-10, a shaft bore 13 of the drive core 10 may be formed by the drive core wall 11 from the fore sleeve end 3 to the aft sleeve end 4 of the drive sleeve 2. As illustrated in FIGS. 6-10, shaft bore splines 14 may extend from the drive core wall 11 into the shaft bore 13. The shaft bore splines 14 may extend at least a portion of the length of the shaft bore 13. The shaft bore splines 14 may be configured to be drivingly engaged by the respective drive shaft splines 46 (FIG. 1) on the propeller drive shaft 45 in operation of the marine propeller assembly 39.

At least one, and typically, multiple drive ribs 16 may extend from the exterior surface of the drive core wall 11. In some embodiments, four drive ribs 16 may extend from the drive core wall 11 in off-center, equally spaced or unequally spaced-apart relationship to each other; as illustrated. Accordingly, as illustrated in FIG. 2, each drive rib 16 may correspond positionally with and may be centered with respect to a corresponding sleeve lug 5, as illustrated, or a corresponding sleeve flat 6, of the drive sleeve 2. The drive ribs 16 may be disposed in equally spaced relationship to each other. The drive ribs 16 may insert into the respective rib slots 7 in the interior surface of the drive sleeve 2.

Each drive rib 16 may have any longitudinal trajectory as it extends along the length of the drive core 10 from the fore sleeve end 3 to the aft sleeve end 4. For example and without limitation, in various embodiments, the drive ribs 16 may be straight, angled, helical or any combination thereof. The longitudinal trajectories of the rib slots 7 in the drive sleeve 2 may correspond to the longitudinal trajectories of the respective corresponding drive ribs 16 on the drive core 10 to ensure optimal driving engagement between the drive sleeve 2 and the drive core 10 in the assembled compression spring sleeve assembly 1.

Figure 4:
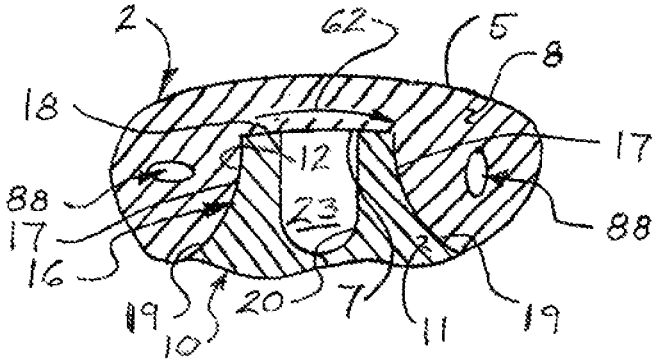
FIG. 4 is an enlarged sectional view of the drive rib on the drive core engaging the rib slot in the drive sleeve with the drive core rotating the drive sleeve in the reverse rotational direction and radial deformation of the axial deformation element on the driving side of the drive rib and transverse deformation of the axial deformation element on the trailing side of the drive rib.

As illustrated in FIGS. 3 and 4, each drive rib 16 of the drive core 10 may have a pair of side rib surfaces 17. An outer rib surface 18 may extend between the side rib surfaces 17. A rib base 19 may extend from the side rib surfaces 17. The rib base 19 may form the junction between the drive rib 16 and the drive core wall 11 of the drive core 10. The side rib surfaces 17, the outer rib surface 18 and the rib base 19 may engage or join the drive sleeve body 8 of the drive sleeve 2 along the sleeve/core interface 12.

In some embodiments, the rib base 19 may have a curved or concave profile as it transitions from the side rib surfaces 17 to the drive core wall 11 of the drive core 10. In other embodiments, the rib base 19 may have a sharp or squared-off profile between the side rib surfaces 17 to the drive core wall 11. In still other embodiments, the rib base 19 may have a convex profile. Each interior rib slot 7 in the assembly sleeve 2 may be suitably sized and configured such that the exterior side rib surfaces 17, the outer rib surface 18 and the rib base 19 of each corresponding drive rib 16 inserted therein may engage the respective interior surfaces of the rib slot 7 along the sleeve/core interface 12.

Figure 21:
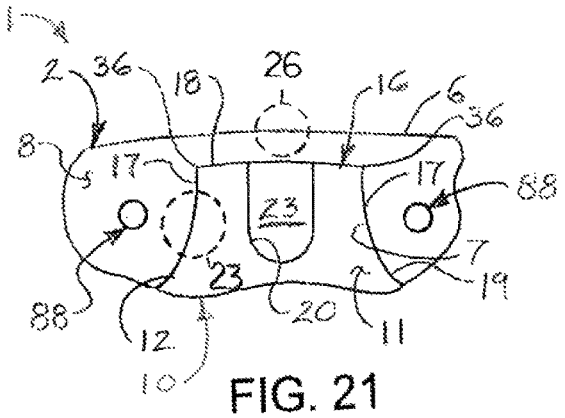
FIG. 21 is an enlarged sectional view of a portion of a compression spring sleeve assembly according to some embodiments of the marine propellers with compression spring sleeve assemblies, having a drive rib with sharp rib edges on the drive core and engaging a companion rib slot in the drive sleeve and an axial deformation element extending through the drive sleeve on each side of the drive rib.
Figure 22:
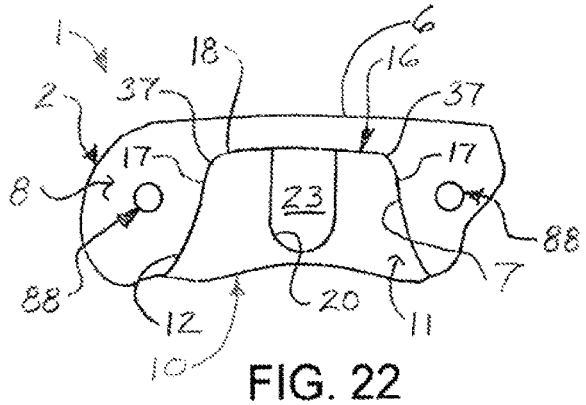
FIG. 22 is an enlarged sectional view of the portion of another compression spring sleeve assembly having the drive rib engaging the rib slot, with radiused rib edges on the drive rib.

As illustrated in FIG. 21, in some embodiments, a sharp ridge edge 36 may extend along the length of each drive rib 16 between the outer rib surface 18 and each corresponding side rib surface 17. As illustrated in FIG. 22, in some embodiments, a radiused rib edge 37 may provide a curved or gradual cross-sectional contour from the outer rib surface 18 to each corresponding side rib surface 17.

Figure 23:
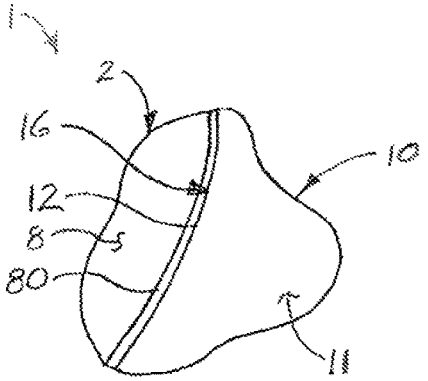
FIG. 23 is an enlarged sectional view, taken along section line 26 in FIG. 21, illustrating a typical compression spring sleeve assembly having an adhesive interface layer at a sleeve/core interface between the drive sleeve and each drive rib on the drive core.
Figure 24:
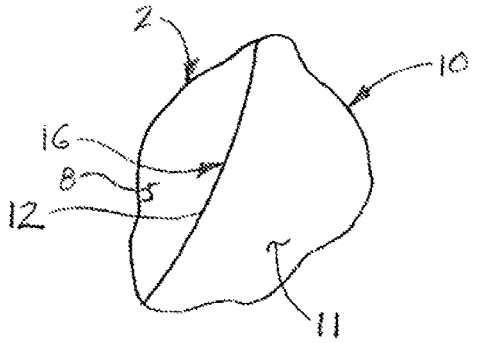
FIG. 24 is an enlarged sectional view of the sleeve/core interface of a typical alternative compression spring sleeve assembly, illustrating a friction fit at the interface.
Figure 25:
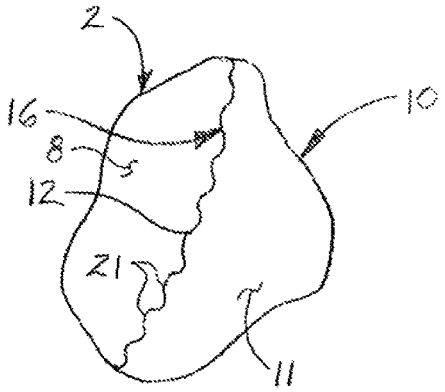
FIG. 25 is an enlarged sectional view of the sleeve/core interface of another alternative compression spring sleeve assembly, illustrating boundary projections at the interface.

As illustrated in FIG. 23, in some embodiments, at least one interface layer 80 may be disposed at the sleeve/core interface 12 between the drive core wall 11 of the drive core 10 and the drive sleeve body 8 of the drive sleeve 2. In some embodiments, the interface layer 80 may include at least one adhesive material, for example and without limitation. As illustrated in FIG. 24, in some embodiments, the sleeve/core interface 12 between the drive core wall 11 and the drive sleeve body 8 may be characterized by a tension fit. The sleeve/core interface 12 may be smooth and uniform, as illustrated in FIG. 24, or may include meshing boundary projections 21, as illustrated in FIG. 25. In some embodiments, the sleeve/core interface 12 may be both characterized by a tension fit and may include the interface layer 80 (FIG. 23).

The width and height of each drive rib 16, as well as the proportions therebetween, may be varied within each drive rib 16 or between drive ribs 16 on the drive core 10 of the same compression spring sleeve assembly 1 to correspondingly select and vary the deformation, shearability and/or spring return characteristics of each drive rib 16 and the compression spring sleeve assembly 1.

As illustrated in FIG. 6, at least one shear cavity 20 may extend into or through at least one drive rib 16 on the drive core 10. Each shear cavity 20 may alter the shear resistance characteristics of one or more of the drive ribs 16 in application of torsional forces from the propeller drive shaft 45 to the propeller hub 42 of the marine propeller 40 via the drive core 10 and the drive sleeve 2, respectively, of the compression spring sleeve assembly 1.

Each shear cavity 20 may have any desired cross-sectional shape to impart the desired shear resistance characteristics or properties to each drive rib 16. For example and without limitation, as illustrated in FIGS. 3 and 4, in some embodiments, each shear cavity 20 may have a U-shaped cross-section and extend into the outer rib surface 18 of the drive rib 16, In other embodiments, each shear cavity 20 may include a closed hole or channel which extends into or through the drive rib 16 along at least a portion of the length of the drive rib 16.

As illustrated in FIGS. 21 and 22, in some embodiments, at least one cavity material 23 may be provided in the shear cavity 20 of each drive rib 16. In some embodiments, the cavity material 23 may include air and/or other gas. In some embodiments, the cavity material 23 may include at least one or a combination of elastomeric materials such as rubber, plastic and/or composite materials, for example and without limitation. In some embodiments, the cavity material 23 may include at least one or a combination of rigid or semirigid materials such as plastic, composites and/or metals, for example and without limitation. In some embodiments, elastomeric, rigid and/or semirigid materials may be combined in selected ratios and/or positions within each shear cavity 20 to achieve the desired shear capability or characteristics of each drive rib 16.

The exterior surface of the drive sleeve 2 and the shear cavity 20 in each drive rib 16 and the drive core 10, as well as the propeller hub drive sleeve 48 of the propeller hub 42 on the marine propeller 40, may be straight, tapered, or any combination thereof from the fore sleeve end 3 to the aft sleeve end 4. In embodiments in which these features are tapered, the taper angles of the features may match one another, or may be dissimilar while working in a complementary manner. For example and without limitation, in some embodiments, exterior surface of the drive sleeve 2 may have a greater taper angle than the interior surface of the propeller hub drive sleeve 48 of the propeller hub 42 such that the drive sleeve 2 imparts a greater force on the forward portion of the propeller hub drive sleeve 48, where the bearing surface has the greatest surface area.

The various dimensional, profile and other parameters and characteristics of each shear cavity 20 may increase, reduce, attenuate or vary the shear resistance characteristics or properties of one or more of the drive ribs 16 in application of the compression spring sleeve assembly 1. The various shear resistance characteristics of the drive ribs 16 may cause the drive ribs 16 to shear or slip at different levels of torque and rotational limits. For example and without limitation, the shear cavity 20 in each drive rib 16 may extend at least a portion of the length of the drive core 10 from the fore sleeve end 3 to the aft sleeve end 4 of the drive sleeve 2. In some embodiments, the shear cavity 20 may be continuous along its length and may extend the entire length of the drive core 10, typically opening to the ends of the drive rib 16 which correspond to the fore sleeve end 3 and the aft sleeve end 4 of the drive sleeve 2. In other embodiments, the shear cavity 20 may extend along less than half, half or more than half the distance between the fore sleeve end 3 and the aft sleeve end 4. In still other embodiments, the shear cavity 20 may be intermittent along its length with multiple shear cavity segments which extend in a sequential linear pattern from the fore sleeve end 3 to the aft sleeve end 4. A segment partition may separate linearly adjacent shear cavity segments from each other along the length of the drive core 10.

Figure 5:
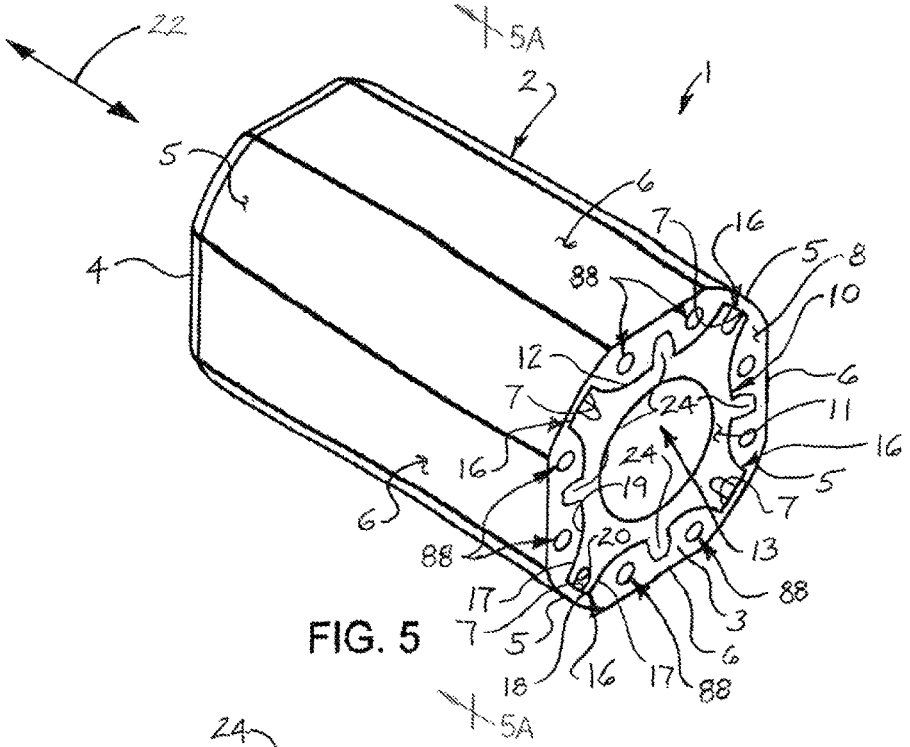
FIG. 5 is a front perspective view of a typical compression spring sleeve assembly of the illustrative marine propeller with compression spring sleeve assembly illustrated in FIG. 1
Figure 28:
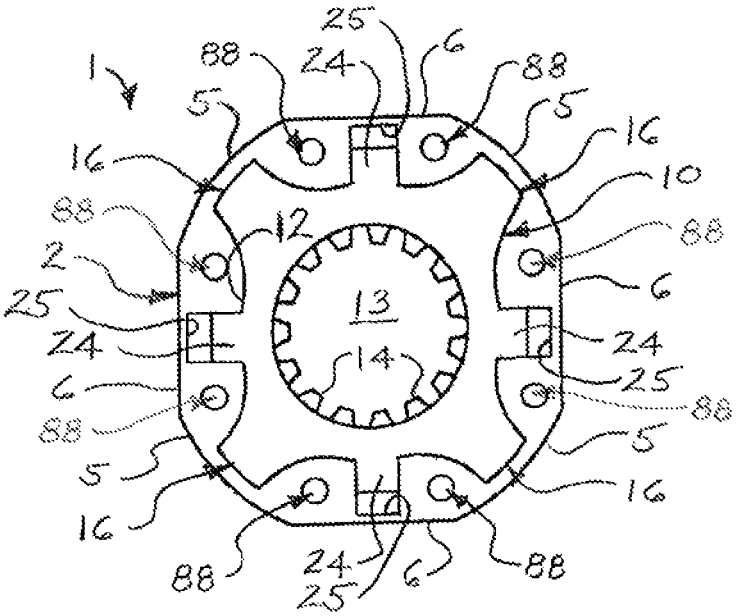
FIG. 28 is a front view of a compression spring sleeve assembly having riblets extending from the drive core and disposed within respective oversized riblet cavities in the drive sleeve according to some embodiments of the marine propellers with compression spring sleeve assemblies.

As illustrated in FIGS. 5 and 6, in some embodiments, at least one riblet 24 may extend outwardly from the drive core wall 11 of the drive core 10 between each pair of adjacent drive ribs 16. Each riblet 24 may insert at least partially into a corresponding riblet cavity 25 in the drive sleeve body 8 of the drive sleeve 2. For example and without limitation, as illustrated in FIG. 6, in some embodiments, each riblet 24 may extend completely into its corresponding riblet cavity 25. As illustrated in FIG. 28, in some embodiments, each riblet 24 may extend partially into its corresponding riblet cavity 25. In some embodiments, the radial length of each riblet 24 may be about half the radial length of each drive rib 16. Each riblet 24 may be equidistant between the adjacent drive ribs 16 or may be closer to one than to the other of the drive ribs 16.

At least one axial deformation element 88 may extend within the drive sleeve body & of the drive sleeve 2. The axial deformation element 88 may be oriented substantially parallel to the axis of rotation 22 (FIGS. 1 and 2) of the propeller hub 42 and may be completely or substantially encased by the outer diameter or perimeter of the drive sleeve body 8. As illustrated in FIGS. 5 and 6, in some embodiments, at least one axial deformation element 88 may be disposed between each drive rib 16 and each corresponding riblet 24. Accordingly, as illustrated in FIGS. 2-4, each axial deformation element 88 may be disposed either on the driving side or the trailing side of the drive rib 16 depending on whether the marine propeller 40 rotates in the forward rotational direction 61 or the reverse rotational direction 62.

Each axial deformation element 88 may have a shore hardness, deformability, modulus of elasticity, shearability, density, and/or other resiliency characteristics or properties which may be greater or less than that of the drive sleeve body 8. Accordingly, the various characteristics such as length, number of segments, materials, and the like of each axial deformation element 88 may be selected, typically as will be hereinafter described, to provide an engineered deformation, spring return and/or shearability characteristics or properties for optimum driveline performance and protection of the marine propeller 40.

Figure 5A:
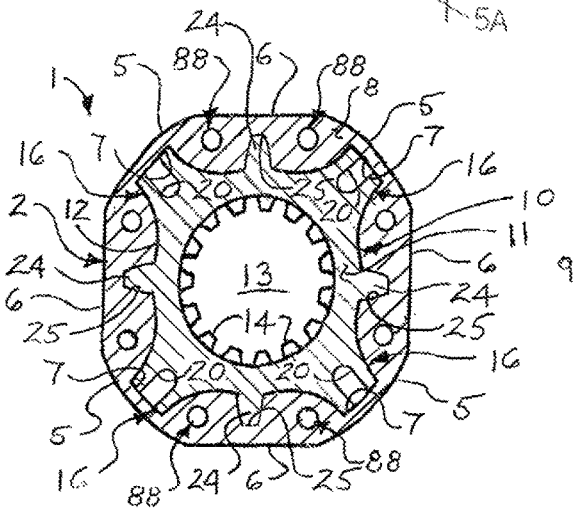
FIG. 5A is a cross-sectional view of the assembly, taken perpendicular to the axis of rotation of the propeller hub along section lines 5A-5A in FIG. 5.
Figure 7:
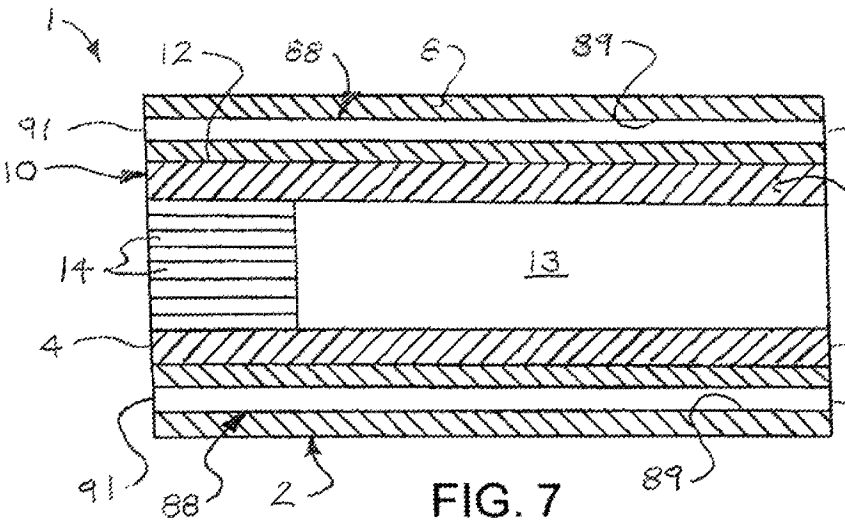
FIG. 7 is a longitudinal sectional view, taken along section lines 7-7 in FIG. 6, of the illustrative compression spring sleeve assembly, more particularly illustrating a pair of axial deformation elements each having a dual open-ended deformation passageway extending longitudinally through the drive sleeve body of the drive sleeve of the assembly.

As illustrated in FIGS. 7-20, it will be appreciated by those skilled in the art that the number, shape, size, and other characteristics of the axial deformation elements 88 in the drive sleeve 2 may be selected to impart the desired characteristics or properties to the compression spring sleeve assembly 1. For example and without limitation, as illustrated in FIG. 7, in some embodiments, at least one axial deformation element 88 in the drive sleeve 2 may include at least one deformation passageway 89. The deformation passageway 89 may extend at least a portion of the length between the fore sleeve end 3 and the aft sleeve end 4 of the drive sleeve 2. In some embodiments, the deformation passageway 89 may be continuous in length and may be dually open-ended, having a fore passageway end 90 at the fore sleeve end 3 and an aft passageway end 91 at the aft sleeve end 4, as illustrated. Accordingly, the deformation passageway 89 may be hollow and filled with ambient air along its length. As illustrated in FIGS. 5 and 5A, the deformation passageway 89 of each axial deformation element 88 may be fully encased by the drive sleeve body 8 throughout a cross-section of the drive sleeve 2 of the compression spring sleeve assembly 1 as taken perpendicular to the axis of rotation 22 of the propeller hub 42 (FIG. 1).

Figure 8:
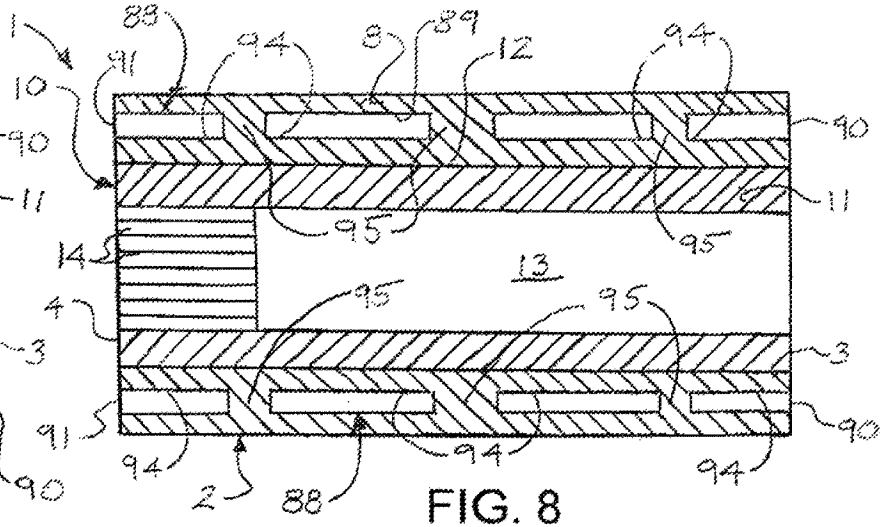
FIG. 8 is a longitudinal sectional view of an alternative compression spring sleeve assembly having a pair of axial deformation elements each with multiple deformation element segments separated by segment partitions extending longitudinally through the drive sleeve body of the drive sleeve.

As illustrated in FIG. 8, in some embodiments, at least one axial deformation element 88 in the drive sleeve 2 may include at least one deformation passageway 89 having at least two deformation passageway segments 94. The deformation passageway segments 94 of each deformation passageway 89 may be oriented in substantially axially aligned or registering relationship to each other from the fore sleeve end 3 to the aft sleeve end 4. One or more segment partitions 95 may separate adjacent deformation passageway segments 94 from each other in the deformation passageway 89. The fore passageway end 90 and the aft passageway end 91 of each deformation passageway 89 may be open-ended at the respective fore sleeve end 3 and aft sleeve end 4.

Figure 9:
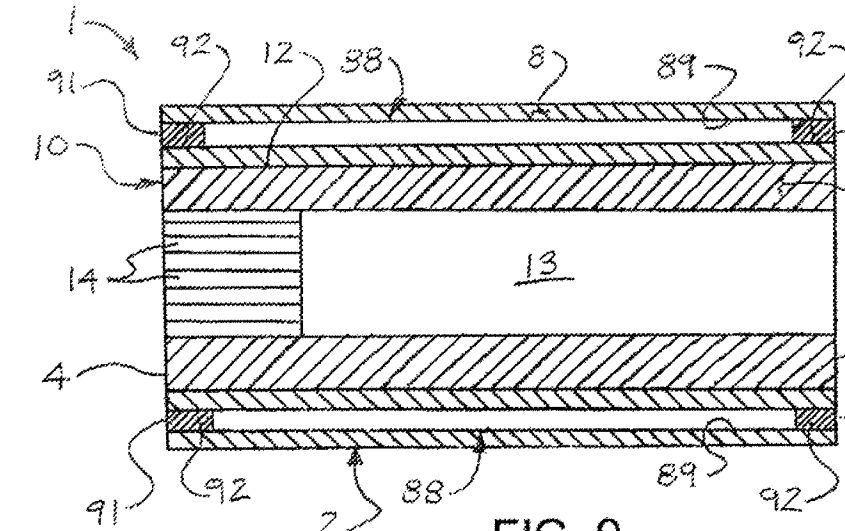
FIG. 9 is a longitudinal sectional view of another alternative compression spring sleeve assembly having a pair of axial deformation elements each with a deformation passageway extending longitudinally through the drive sleeve body of the drive sleeve and a passage plug inserted in the fore passageway end and the aft passageway end of each deformation passageway.
Figure 11:
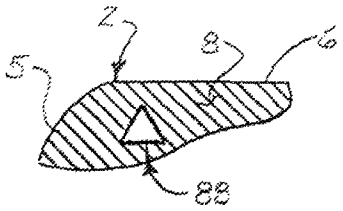
FIG. 11 is an enlarged sectional view, taken along section line 11 in FIG. 6, of a portion of the drive sleeve body of the drive sleeve of a compression spring sleeve assembly according to some embodiments of the marine propellers with compression spring sleeve assemblies, more particularly illustrating an axial deformation element having a triangular cross-section.
Figure 12:
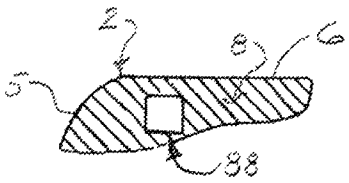
FIG. 12 is an enlarged sectional view, also taken along section line 11 in FIG. 6, of a portion of the drive sleeve body of the drive sleeve of an alternative compression spring sleeve assembly having an axial deformation element with a square cross-section.
Figure 13:
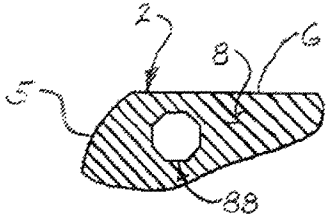
FIG. 13 is an enlarged sectional view, taken along section line 11 in FIG. 6, of a compression spring sleeve assembly having an axial deformation element with an octagonal cross-section.
Figure 14:
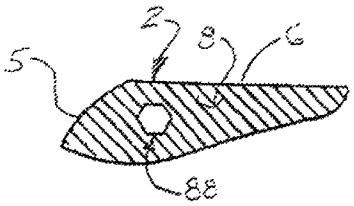
FIG. 14 is an enlarged sectional view, taken along section line 11 in FIG. 6, of a compression spring sleeve assembly having an axial deformation element with a hexagonal cross-section.
Figure 15:
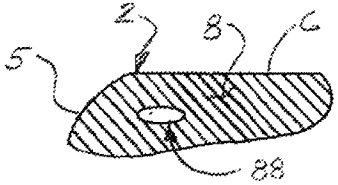
FIG. 15 is an enlarged sectional view, taken along section line 11 in FIG. 6, of a compression spring sleeve assembly having an axial deformation element with an oval cross-section and oriented along a transverse axis.
Figure 16:
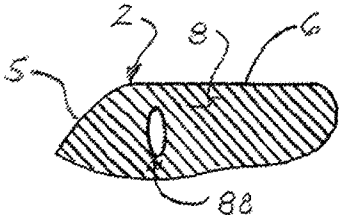
FIG. 16 is an enlarged sectional view, taken along section line 11 in FIG. 6, of a compression spring sleeve assembly having an axial deformation element with an oval cross-section and oriented along a radial axis.
Figure 17:
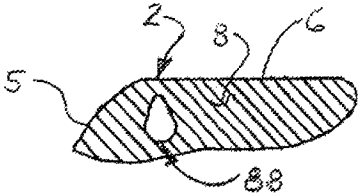
FIG. 17 is an enlarged sectional view, taken along section line 11 in FIG. 6, of a compression spring sleeve assembly having an axial deformation element with a teardrop shape.

As illustrated in FIG. 9, in some embodiments, at least one axial deformation element 88 in the drive sleeve 2 may include at least one deformation passageway 89 having a fore passageway end 90 at the fore sleeve end 3 and an aft passageway end 91 at the aft sleeve end 4. A passage plug 92 may be inserted in one or both of the fore passageway end 90 and the aft passageway end 91. Air and/or other gas may fill the deformation passageway 89.

Alternatively, the deformation passageway 89 may have negative air or gas pressure. In some embodiments, the deformation passageway 89 may be continuous from the fore passageway end 90 to the aft passageway end 91, as illustrated. In other embodiments, the deformation passageway 89 may have at least two deformation passageway segments 94 separated by at least one segment partition 95, typically as was heretofore described with respect to FIG. 8.

Figure 10:
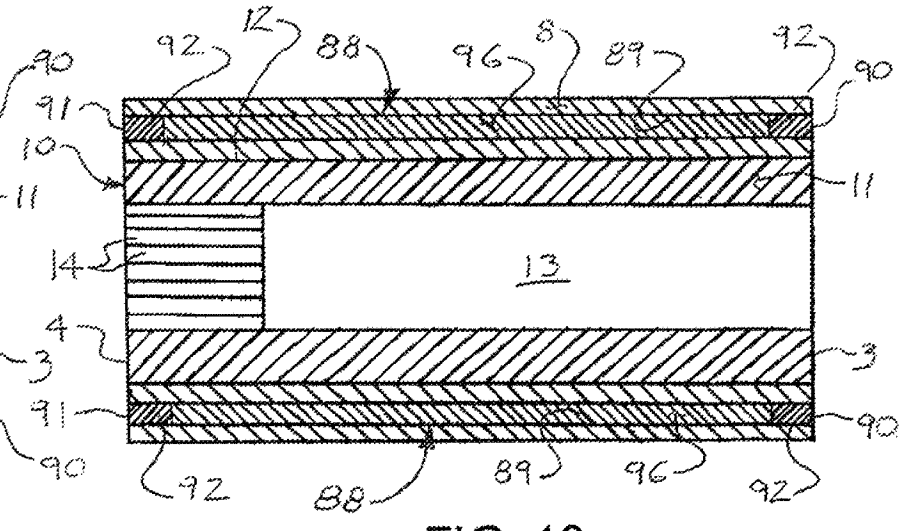
FIG. 10 is a longitudinal sectional view of still another alternative compression spring sleeve assembly having a pair of axial deformation elements each with a deformation passageway extending longitudinally through the drive sleeve body of the drive sleeve, a passage plug inserted in the fore passageway end and the aft passageway end of each deformation passageway and a deformation material filling the deformation passageway between the passage plugs.

As illustrated in FIG. 10, in some embodiments, at least one axial deformation element 88 in the drive sleeve 2 may include at least one deformation passageway 89 having a fore passageway end 90 at the fore sleeve end 3 and an aft passageway end 91 at the aft sleeve end 4. A passage plug 92 may be inserted in one or both of the fore passageway end 90 and the aft passageway end 91. At least one deformation material 96 may be provided in the deformation passageway 89 between the passage plugs 92. The deformation material 96 may have a shore hardness, deformability, modulus of elasticity, shearability, porosity, density, and/or other resiliency characteristics or properties which may be greater or less than those characteristics or properties of the drive sleeve body 8 of the drive sleeve 2. In some embodiments, the deformation passageway 89 may be continuous from the fore passageway end 90 to the aft passageway end 91, as illustrated. In other embodiments, the deformation passageway 89 may have at least two deformation passageway segments 94 separated by at least one segment partition 95, typically as was heretofore described with respect to FIG. 8.

The deformation material 96 may include rubber, plastic, composites, acetal, metal or combinations thereof, for example and without limitation. In some embodiments, the deformation material 96 may include air and/or other gas. In some embodiments, the deformation material 96 may include at least one or a combination of elastomeric materials such as rubber, plastic and/or composite materials, for example and without limitation. In some embodiments, the deformation material 96 may include at least one or a combination of rigid or semirigid materials such as plastic, composites and/or metals, for example and without limitation. In some embodiments, elastomeric, rigid and/or semirigid materials may be combined in selected ratios and/or positions within the deformation passageway 89 to achieve the desired deformation, shearability and/or spring return characteristics of each axial deformation element 88.

As illustrated in FIGS. 11-17, each axial deformation element 88 may have any of a variety of cross-sectional shapes. For example and without limitation, in various non-limiting embodiments, at least one axial deformation element 88 in the drive sleeve 2 may be triangular (FIG. 11); rectangular or square (FIG. 12); octagonal (FIG. 13); hexagonal (FIG. 14); elliptical or oval and oriented transversely within the drive sleeve body 8 (FIG. 15); elliptical or oval and oriented radially within the drive sleeve body 8 (FIG. 16); elliptical or oval and oriented in a slanted orientation within the drive sleeve body 8 (not illustrated); or teardrop-shaped (FIG. 17) in cross-section. The size and cross-sectional shape and orientation of each axial deformation element 88 within the drive sleeve body 8 may be selected to vary the deformation, shearability and/or spring return characteristics of the drive sleeve 2 for a particular application of the marine propeller assembly 39.

Figure 18:
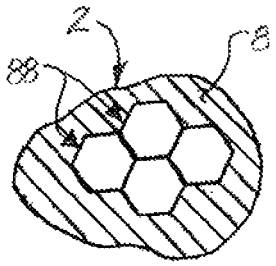
FIG. 18 is an enlarged sectional view of a portion of the drive sleeve body of the drive sleeve of another compression spring sleeve assembly with multiple axial deformation elements linked together in a honeycomb pattern.
Figure 19:
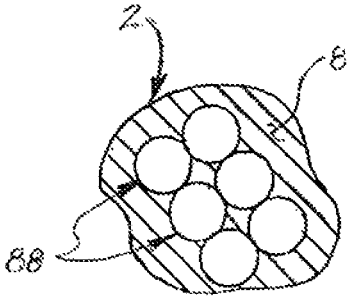
FIG. 19 is an enlarged sectional view of a portion of the drive sleeve body of the drive sleeve of another compression spring sleeve assembly with multiple axial deformation elements linked together in a slanted pattern.
Figure 20:
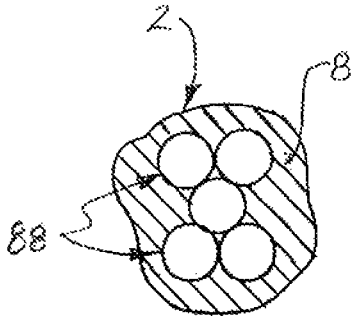
FIG. 20 is an enlarged sectional view of a portion of the drive sleeve body of the drive sleeve of another compression spring sleeve assembly with multiple axial deformation elements linked together in an alternative pattern.

As illustrated in FIGS. 18-20, in some embodiments, multiple axial deformation elements 88 may be linked together in a selected pattern. For example and without limitation, as illustrated in FIG. 18, in some embodiments, multiple hexagonal axial deformation elements 88 (FIG. 18) may be linked together in a honeycomb pattern. As illustrated in FIG. 19, in other embodiments, multiple axial deformation elements 88 may be linked together in a slanted pattern. As illustrated in FIG. 20, in still other embodiments, multiple axial deformation elements 88 may be linked together in an alternative pattern. The number, shape, size, porosity, density and/or other characteristics of the axial deformation elements 88 may be selected to impart the desired shore hardness, deformability, modulus of elasticity, shearability, and/or other resiliency characteristics or properties to the drive sleeve 2.

As illustrated in FIGS. 1-4, in typical assembly and application of the marine propeller assembly 39, the compression spring sleeve assembly 1 may be inserted in the propeller hub 42 of the marine propeller 40. Accordingly, as illustrated in FIG. 2, the sleeve lugs 5 and the sleeve flats 6 on the exterior surface of the drive sleeve 2 may engage the companion lug slots 49 and hub drive sleeve flats 50, respectively, on the interior surface of the propeller hub drive sleeve 48 of the propeller hub 42. As illustrated in FIG. 1, the propeller drive shaft 45 may be inserted typically initially through a thrust washer 84 and then through the shaft bore 13 in the drive core 10 of the drive sleeve 2 as the drive shaft splines 46 on the propeller drive shaft 45 mesh with the companion shaft bore splines 14 in the shaft bore 13 of the drive core 10.

As further illustrated in FIG. 1, a lock assembly 70 may be deployed to secure the marine propeller 40 on the propeller drive shaft 45. In some embodiments, the lock assembly 70 may include a lock adaptor 71 which is placed over the aft end of the propeller drive shaft 45. A tab washer 74 may engage the lock adaptor 71. A lock nut 78 may be threaded on the drive shaft threads 47 on the aft end of the propeller drive shaft 45 and tightened against the tab washer 74.

In operation of the outboard motor on the marine vehicle, the compression spring sleeve assembly 1 may transmit forward and reverse torsional forces from the propeller drive shaft 45 to the marine propeller 40 through the drive core 10 and the drive sleeve 2 as the marine vehicle on which the outboard motor that drivingly engages the propeller drive shaft 45 is propelled on a water body. As illustrated in FIG. 2, as it rotates in the forward rotational direction 61, the marine propeller 40 propels the marine vehicle forwardly on the water body. As it rotates in the reverse rotational direction 62, the marine propeller 40 propels the marine vehicle in reverse on the water body.

Throughout forward and reverse operation of the marine vehicle, the drive core 10 transmits the torsional forces from the propeller drive shaft 45 to the drive sleeve 2 of the compression spring sleeve assembly 1 via the drive ribs 16 on the drive core 10. The drive sleeve 2 transmits the torsional forces from the drive core 10 to the propeller hub drive sleeve 48 of the marine propeller 40 via engagement of the exterior sleeve lugs 5 and sleeve flats 6 on the drive sleeve 2 with the respective companion lug slots 49 and hub drive sleeve flats 50 on the interior surface of the propeller hub drive sleeve 48. The drive sleeve 2 may absorb vibration during gear changing. Additionally, the typically elastomeric construction of the drive sleeve 2, particularly the elastic and torsional resistance properties of the axial deformation elements 88 in the drive sleeve 2, may eliminate or reduce deadband or "play" between the propeller 40 and the propeller drive shaft 45 upon termination of torque applied to the propeller drive shaft 45, typically as will be hereinafter described.

As illustrated in FIG. 2, in the non-operative state of the marine propeller 40, each axial deformation element 88 may have a circular configuration in end view or cross-section. Upon initial startup, the propeller drive shaft 45 may rotate the marine propeller 40 in the counterclockwise forward rotational direction 61 in FIGS. 2 and 3. Accordingly, each drive rib 16 on the drive core 10 may apply positive pressure against the axial deformation element 88 on the driving side (to the left) of the drive rib 16. As illustrated in FIG. 3, the axial deformation element 88 on the driving side (to the left) of the drive rib 16 may thus become compressed in the transverse direction and elongate in the radial direction as that axial deformation element 88 initially absorbs the positive pressure applied by the drive rib 16. Simultaneously, the axial deformation element 88 on the trailing side (to the right) of the drive rib 16 may expand and elongate in the transverse direction and shorten in the radial direction as the drive rib 16 applies negative pressure to that axial deformation element 88.

Conversely, upon operation of the marine propeller 40 in the clockwise reverse rotational direction 62 in FIG. 4, each drive rib 16 on the drive core 10 may apply positive pressure against the axial deformation element 88 on the driving side (to the right) of the drive rib 16, and that axial deformation element 88 may become compressed in the transverse direction and elongated in the radial direction as the axial deformation element 88 initially absorbs the positive pressure applied by the drive rib 16. Simultaneously, the axial deformation element 88 on the trailing side (to the left) of the drive rib 16 may expand and elongate in the transverse direction and shorten in the radial direction as the drive rib 16 applies negative pressure to that axial deformation element 88. As the propeller drive shaft 45 reaches operational speed, the transverse and radial distortion or deformation of each axial deformation element 88 may normalize and return to or approach the initial undistorted configuration. The deforming axial deformation elements 88 may thus absorb both the initial startup pressure in the forward rotational direction 61 and reverse operational pressure in the reverse rotational direction 62 which the propeller drive shaft 45 applies to the marine propeller 40, as well as absorb torsional pressure upon termination of torque applied to the propeller drive shaft 45 to eliminate or reduce deadband or "play" between the propeller 40 and the propeller drive shaft 45. The axial deformation elements 88 may also attenuate or dampen torsional forces transmitted from the propeller drive shaft 45 to the marine propeller 40 to reduce shock and impact sounds and absorb vibration during gear changing or propeller striking events.

The shear properties of the axial deformation elements 88 may impart shearing characteristics to the drive sleeve 2 for optimum driveline protection during propeller striking events, sudden gear changes and the like. In some applications in which the propeller blades 41 of the marine propeller 40 strike a submerged obstacle in the forward rotational direction 61 of the marine propeller 40, rotation of the marine propeller 40 may suddenly stop or substantially slow as the propeller drive shaft 45 continues to rotate at operational speed. Accordingly, one or more of the axial deformation elements 88 may partially or completely shear or shear at different rates. The fractured axial deformation elements 88 may thus absorb the strike force which may otherwise be borne by the propeller blades 41, other components of the marine propeller 40, the propeller drive shaft 45 and/or other components of the drivetrain, thus preventing or minimizing the likelihood of damaging these components. The same effect may result in rotation of the marine propeller 40 in the reverse rotational direction 62. The axial deformation elements 88 on the opposite sides of each drive rib 16, and in the drive sleeve 2 as a whole, may have the same or different characteristics and properties and may be selected, mixed and matched to achieve the properties which are optimum for a particular power output, propeller size and application.

As illustrated in FIG. 6, it will be appreciated by those skilled in the art that the shear resistance characteristics of each axial deformation element 88 in the drive sleeve 2 may be selected to achieve a desired shearability or shear resistance of the drive sleeve 2 as measured by a tear limit angle 98 of the drive sleeve 2. The tear limit angle 98 may correspond to the rotational distance in degrees, within a 360-degree range, which each drive rib 16 travels before being stopped by the portion of the drive sleeve 2 which remains as the drive sleeve 2 is sheared, typically in the event that the marine propeller 40 strikes a submerged obstacle, for example. The tear limit angle 98 may depend at least in part on the relative shearability of the selected axial deformation elements 88 in the drive sleeve 2. For example and without limitation, selection of axial deformation elements 88 having a relatively low shearability (high shear resistance) may result in a small tear limit angle 98*a* which corresponds to a relatively small rotational distance. Conversely, selection of axial deformation elements 88 having a relatively high shearability (low shear resistance) may result in a large tear limit angle 98*c* which is greater than the small tear limit angle 98*a* and corresponds to a relatively high rotational distance of the drive sleeve 2. Selection of axial deformation elements 88 having a shearability or shear resistance which is between that of the axial deformation elements 88 having the low shearability and the axial deformation elements 88 having the high shearability may result in an intermediate tear limit angle 98*b* which is between that of the small tear limit angle 98*a* and the large tear limit angle 98*c*.

Figures 29, 30A, 30B:
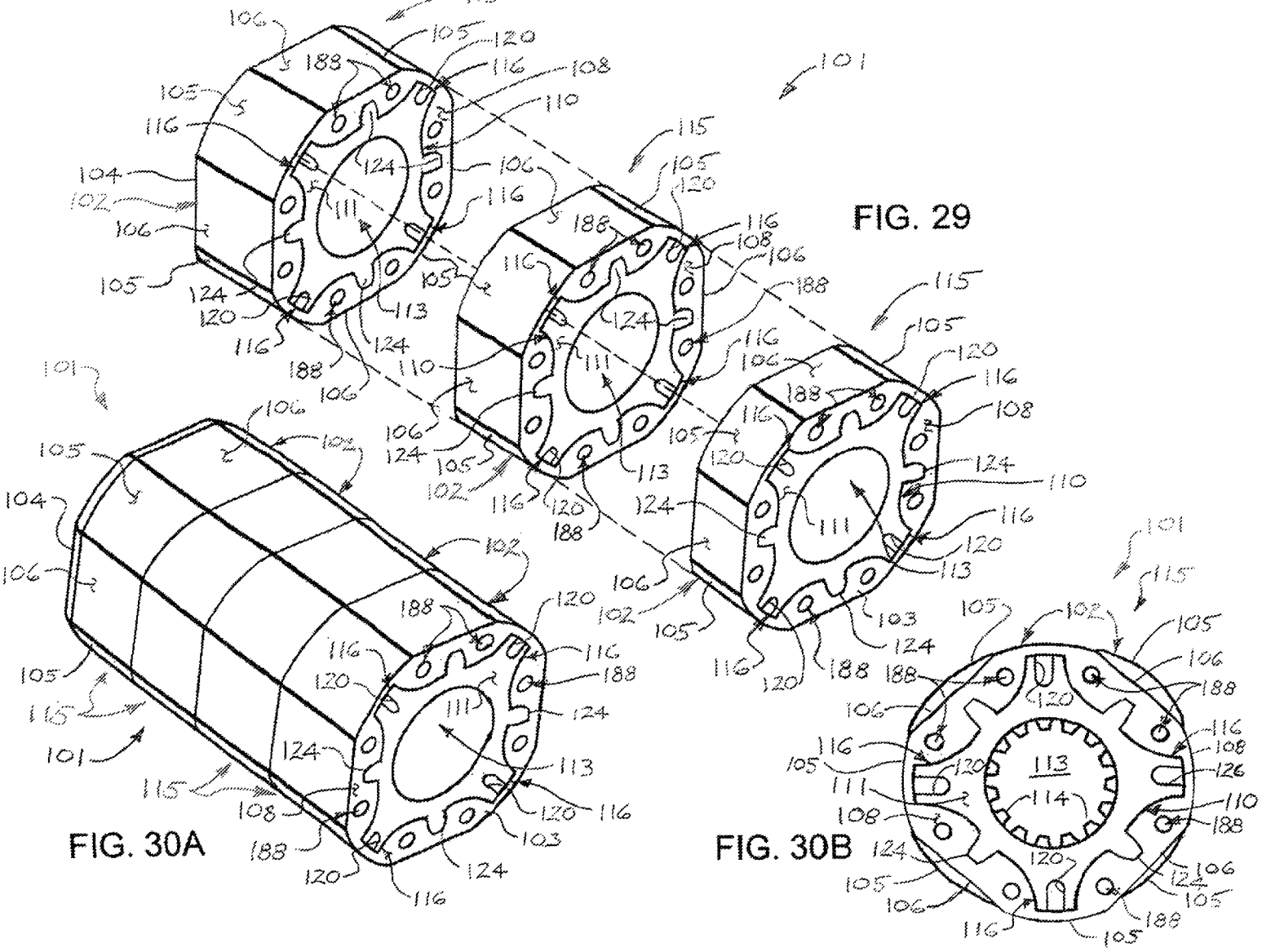
FIG. 29 is an exploded front perspective view of an illustrative multi-sectioned compression spring sleeve assembly with the sleeve sections of the assembly oriented in aligned or registering relationship to each other, according to some embodiments of the marine propellers with compression spring sleeve assemblies.
FIG. 30A is a front perspective view of the assembled multi-sectioned compression spring sleeve assembly.
FIG. 30B is a front view of an illustrative multi-sectioned compression spring sleeve assembly with the sleeve sections of the assembly oriented in offset relationship to each other.
Figure 31:
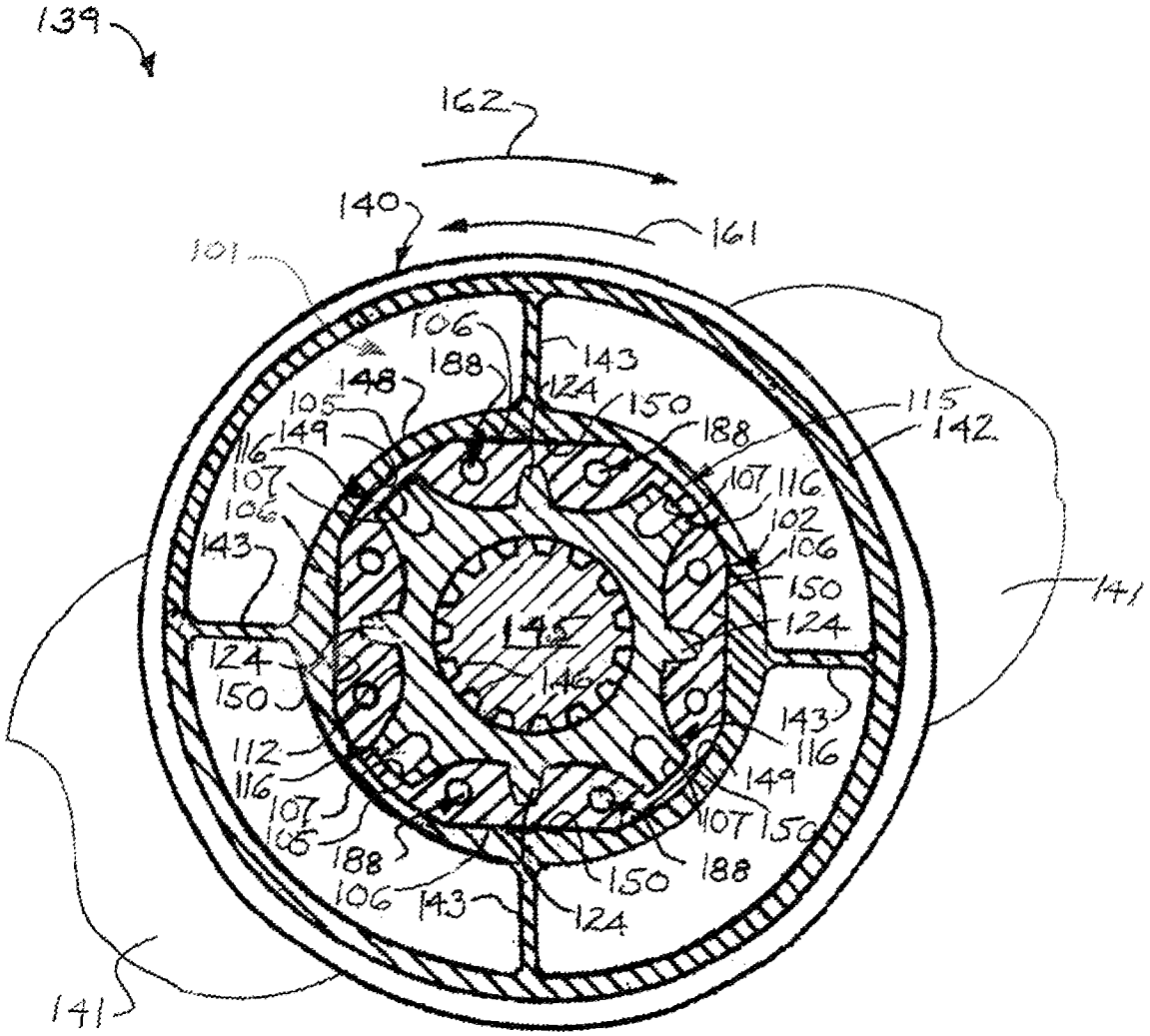
FIG. 31 is a cross-sectional view of the propeller hub of an assembled marine propeller having the multi-sectioned spring sleeve assembly illustrated in FIGS. 29-30B, deployed in place in the propeller hub.

Referring next to FIGS. 29-31 of the drawings, an alternative illustrative embodiment of the marine propeller with compression spring sleeve assembly is generally indicated by reference numeral 139 in FIG. 31. In the marine propeller assembly 139, elements which are analogous to the respective elements of the marine propeller assembly 39 that was heretofore described with respect to FIGS. 1-28 are designated by the same respective numerals in the 101-199 series in FIGS. 29-31. Accordingly, the compression spring sleeve assembly 101 of the marine propeller assembly 139 may be multi-sectioned, with multiple sleeve sections 115. Each sleeve section 115 may include a corresponding portion or section of the drive core 110 and the drive sleeve 102 which are independently drivingly engaged by the propeller drive shaft 145. The axial deformation elements 188 may be divided into corresponding segments which extend through the drive sleeves 102 of the respective sleeve sections 11S.

The axial deformation elements 188 in each sleeve section 115 may have the same or different characteristics and properties as those of the axial deformation elements 188 in the other sleeve sections 115, as well as within the same sleeve section 115. Accordingly, sleeve sections 115 having various shore hardness, deformability, modulus of elasticity, shearability, and/or other resiliency characteristics or properties may be selected, mixed and matched to achieve a multi-sectioned compression spring sleeve assembly 101 having the desired characteristics or properties which are optimum for a particular power output, propeller size and application.

In some embodiments, the sleeve sections 115 may be disposed at various orientations with respect to each other in the multi-sectioned compression spring sleeve assembly 101 to achieve any of various characteristics or properties for a particular application. For example and without limitation, as illustrated in FIGS. 29 and 30A, in some embodiments of the multi-sectioned compression spring sleeve assembly 101, the sleeve sections 115 may be oriented in substantially aligned or registering relationship to each other. As illustrated in FIG. 30B, in other embodiments, the sleeve sections 115 of the multi-sectioned compression spring sleeve assembly 101 may be oriented in offset relationship to each other.

In typical assembly of the marine propeller assembly 139, the multi-sectioned compression spring sleeve assembly 101 may be assembled by sequentially inserting the sleeve sections 115 in the propeller hub 42 (FIG. 1) of the marine propeller 40 with the sleeve lugs 105 and the sleeve flats 106 on the exterior surface of the drive sleeve 102 engaging the companion lug slots 49 and hub drive sleeve flats 50, respectively, on the interior surface of the propeller hub drive sleeve 48 of the propeller hub 42. The propeller drive shaft 45 (FIG. 1) may be inserted typically initially through a thrust washer 84 and then through the shaft bores 113 in the drive cores 110 of the respective sleeve sections 115 of the drive sleeve 102 as the drive shaft splines 146 on the propeller drive shaft 145 mesh with the companion shaft bore splines 114 in the shaft bore 113 of the drive core 110. The lock assembly 70 may be deployed to secure the marine propeller 140 on the propeller drive shaft 145, typically as was heretofore described with respect to the marine propeller assembly 39 in FIG. 1. Operation of the marine propeller assembly 139 may be as was heretofore described with respect to the marine propeller assembly 39 in FIGS. 1-28.

Figure 32:
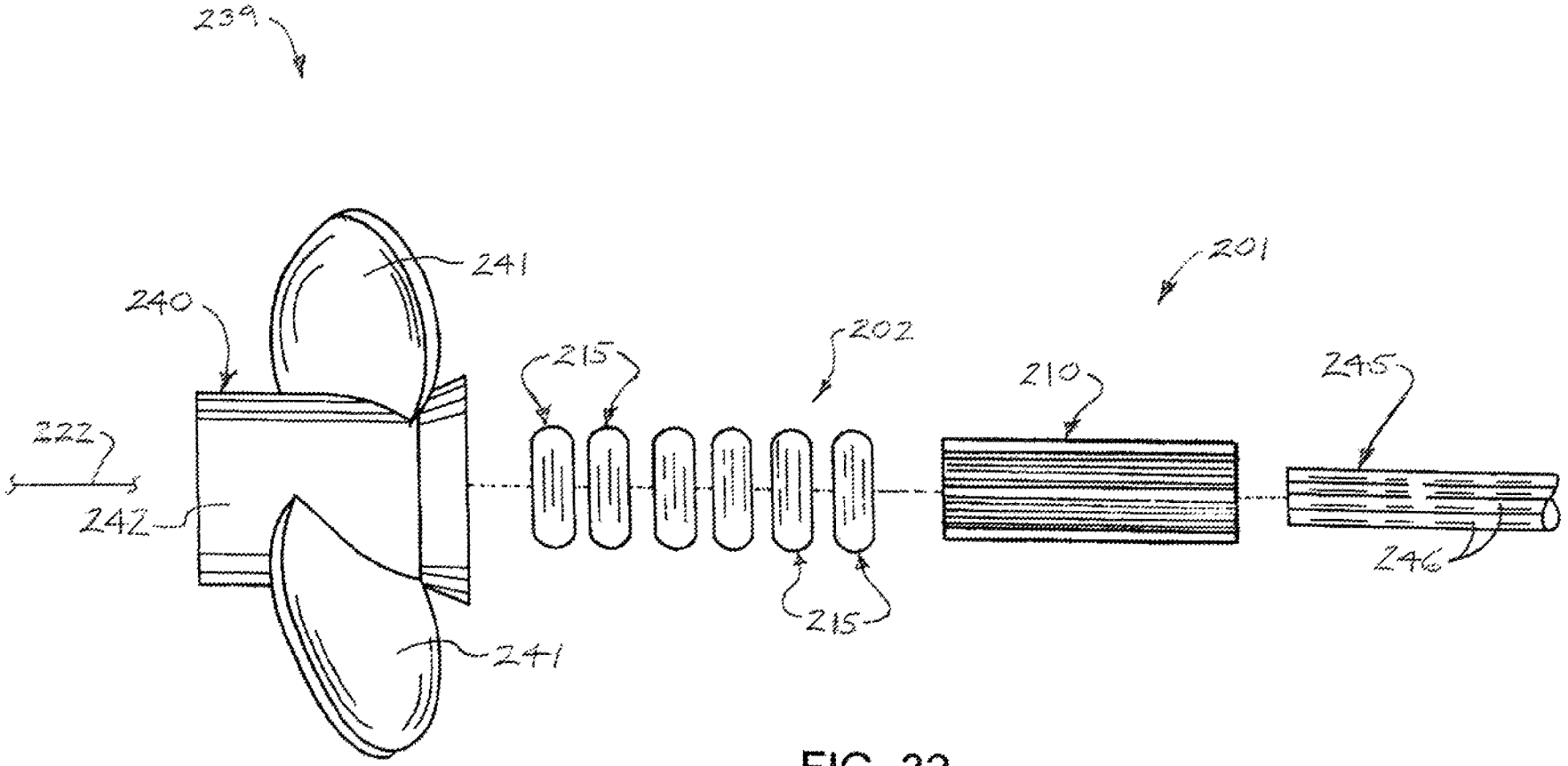
FIG. 32 is an exploded side view of another alternative illustrative embodiment of the marine propellers with compression spring sleeve assemblies, having a compression spring sleeve assembly with sleeve sections shaped in the form of O-rings.
Figure 33:
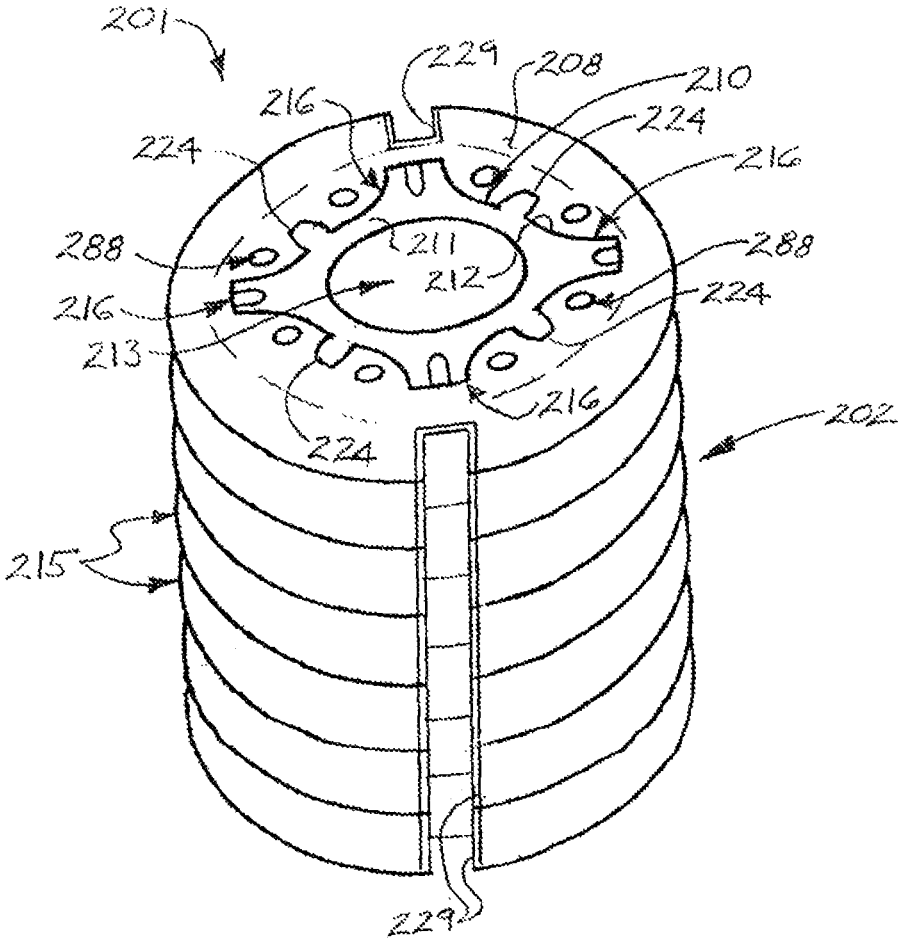
FIG. 33 is a perspective view of the illustrative compression spring sleeve assembly illustrated in FIG. 32.
Figure 34:
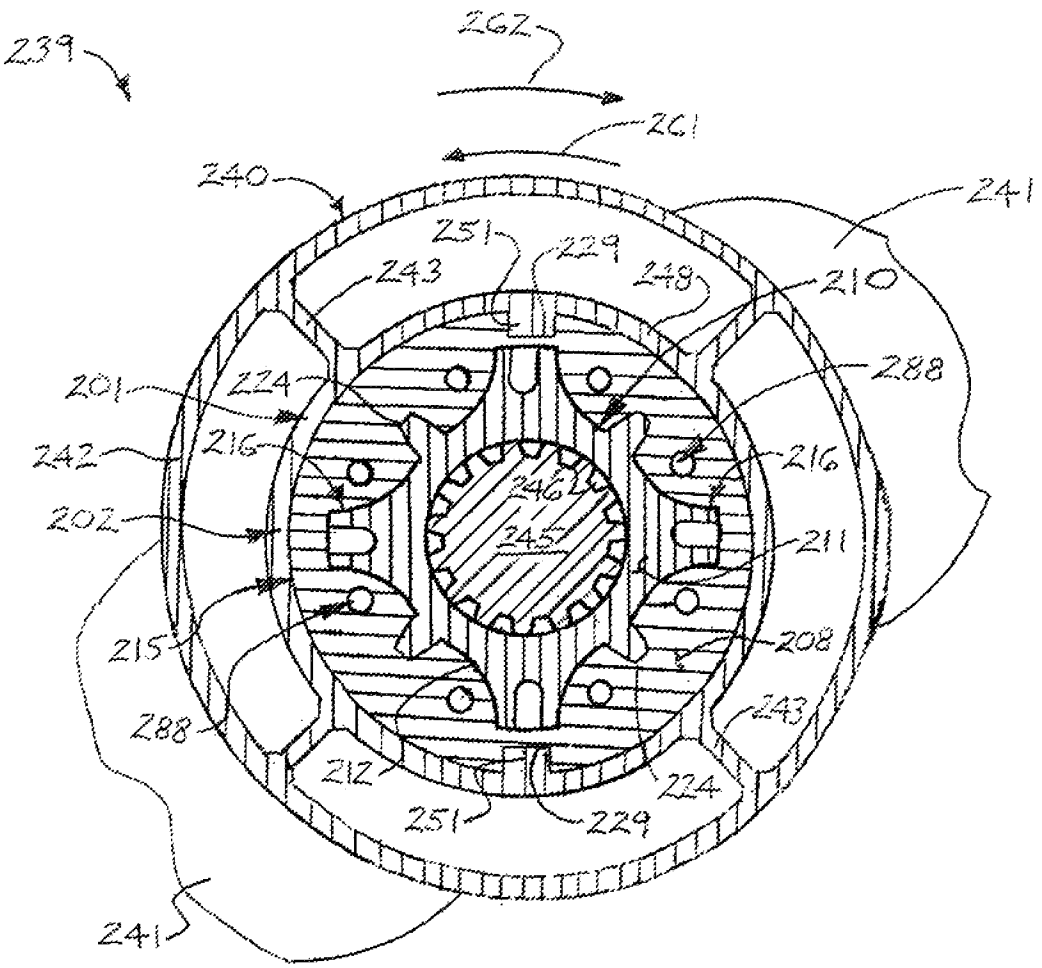
FIG. 34 is a cross-sectional view of the propeller hub of the assembled marine propeller with compression spring sleeve assembly illustrated in FIG. 32.

Referring next to FIGS. 32-34 of the drawings, an alternative illustrative embodiment of the marine propeller assembly is generally indicated by reference numeral 239 in FIG. 32. In the marine propeller assembly 239, elements which are analogous to the respective elements of the marine propeller assembly 139 that was heretofore described with respect to FIGS. 29-31 are designated by the same respective numerals in the 201-299 series in FIGS. 32-34. Accordingly, the multi-sectioned compression spring sleeve assembly 201 of the marine propeller assembly 239 may include multiple sleeve sections 215 shaped in the form of O-rings. Each sleeve section 215 may include a corresponding portion or section of the drive core 210 and the drive sleeve 202 which are independently drivingly engaged by the propeller drive shaft 145. The axial deformation elements 288 may be divided into corresponding segments which extend through the respective sleeve sections 215.

The axial deformation elements 288 in each sleeve section 215 may have the same or different characteristics and properties as those of the axial deformation elements 288 in the other sleeve sections 215, as well as within the same sleeve section 215. Accordingly, sleeve sections 215 having various shore hardness, deformability, modulus of elasticity, shearability, porosity, density, and/or other resiliency characteristics or properties may be selected, mixed and matched to achieve a multi-sectioned compression spring sleeve assembly 201 having the desired characteristics or properties which are optimum for a particular power output, propeller size and application.

As illustrated in FIGS. 33 and 34, at least one transfer lug notch 229 may extend radially into the drive sleeve body 208 at the exterior circumference of each sleeve section 215. Accordingly, as illustrated in FIG. 34, at least one propeller torque transfer lug 251 may extend inwardly from the propeller hub drive sleeve 248 of the propeller hub 242 of the marine propeller 240. The propeller torque transfer lug 251 may engage the transfer lug notch 229 to drivingly connect the marine propeller 240 to the drive sleeve 202. Additionally or alternatively, one or more propeller torque transfer lugs 251 may extend from each sleeve section 215 and engage a corresponding transfer lug notch 229 in the propeller hub drive sleeve 248 for the same purpose. Typical assembly and operation of the marine propeller assembly 239 may be as was heretofore described with respect to that of the marine propeller with compression spring sleeve assembly 139 in FIGS. 29-31.

Figure 35:
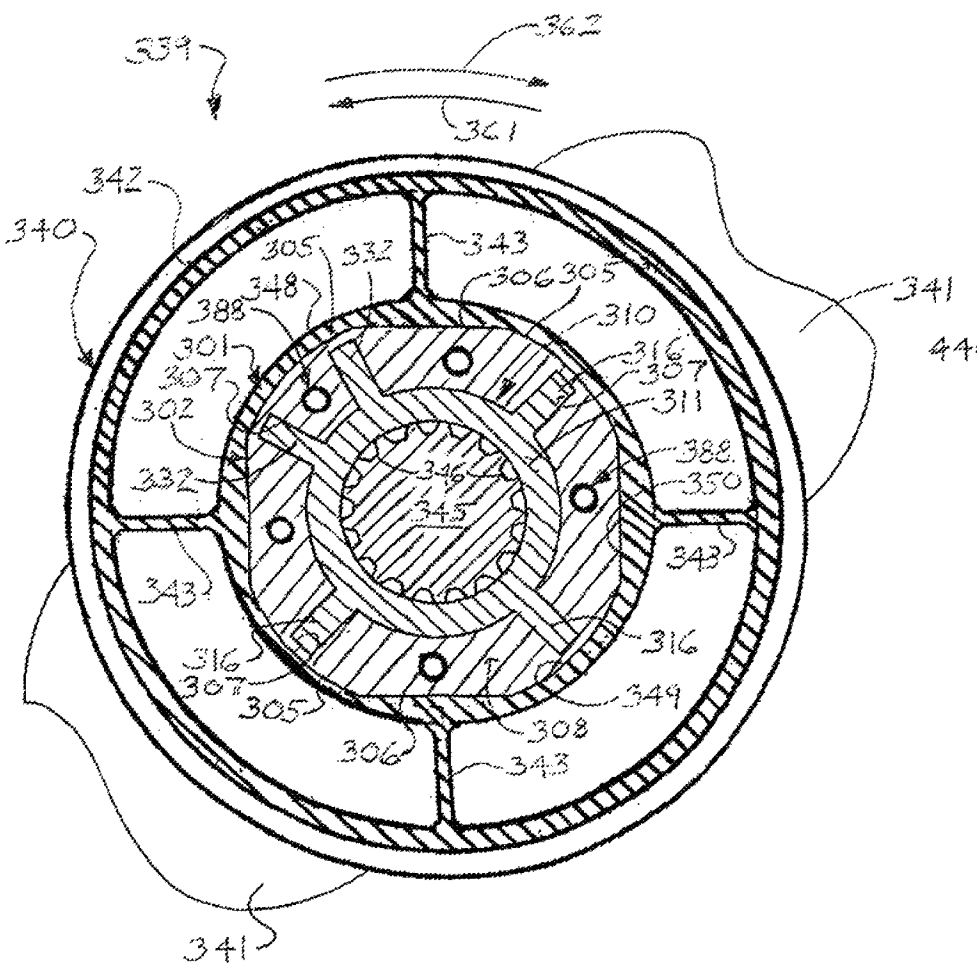
FIG. 35 is a cross-sectional view of the propeller hub of another alternative illustrative embodiment of a marine propeller having a compression spring sleeve assembly with a pair of sacrificial ribs extending from the drive core of the assembly and an axial deformation element between the sacrificial ribs deployed in place in the propeller hub.

Referring next to FIG. 35 of the drawings, another alternative illustrative embodiment of the marine propellers with compression spring sleeve assemblies is generally indicated by reference numeral 339. In the marine propeller assembly 339, elements which are analogous to the respective elements of the marine propeller assembly 39 that was heretofore described with respect to FIGS. 1-28 are designated by the same respective numerals in the 301-399 series in FIG. 35. At least one sacrificial rib 332 may extend from the drive core wall 311 of the drive core 310. Each sacrificial rib 332 may engage a corresponding rib slot 307 in the drive sleeve body 308 of the drive sleeve 302. In some embodiments, a pair of sacrificial ribs 332 may extend from the drive core wall 311 in spaced-apart relationship to each other. The sacrificial ribs 332 may angle away from each other, as illustrated. The sacrificial ribs 332 may correspond positionally to a sleeve lug 305 of the drive sleeve 302, with the remaining drive ribs 316 typically corresponding positionally to the remaining sleeve lugs 305. Alternatively, the sacrificial ribs 332 may correspond positionally to a sleeve flat 306 of the drive sleeve 302.

At least one axial deformation element 388 may extend through the drive sleeve body 308 of the drive sleeve 302. In some embodiments, at least one axial deformation element 388 may be disposed adjacent to at least one sacrificial rib 332. For example and without limitation, in some embodiments, at least one axial deformation element 388 may be disposed between the sacrificial ribs 332 and between each sacrificial rib 332 and corresponding adjacent drive rib 316, as well as between adjacent drive ribs 316, as illustrated.

Application of the marine propeller assembly 339 may be as was heretofore described with respect to the marine propeller assembly 39 in FIGS. 1-28. Accordingly, the drive ribs 316 and the sacrificial ribs 332 may transmit the forward and reverse torsional forces from the drive core 310 to the drive sleeve 302 of the compression spring sleeve assembly 301. The sacrificial ribs 332 may impart offset rotational bias to the drive sleeve 302 for longer rotational movement in the forward rotational direction 361 or the rearward rotational direction 362, respectively. Therefore, in the event that the propeller blades 341 of the marine propeller 340 strike a submerged obstacle in a water body, the sacrificial ribs 332 may fracture or break at the drive core wall 311 more readily than the drive ribs 316, thereby absorbing the strike force which may otherwise be borne by the propeller blades 341 and/or other components of the marine propeller 340, the propeller drive shaft 345 and/or other components of the drivetrain. The axial deformation elements 388 may impart the desired deformation, spring return and/or shear properties which are optimum for a particular power output, propeller size and application.

Figure 36:
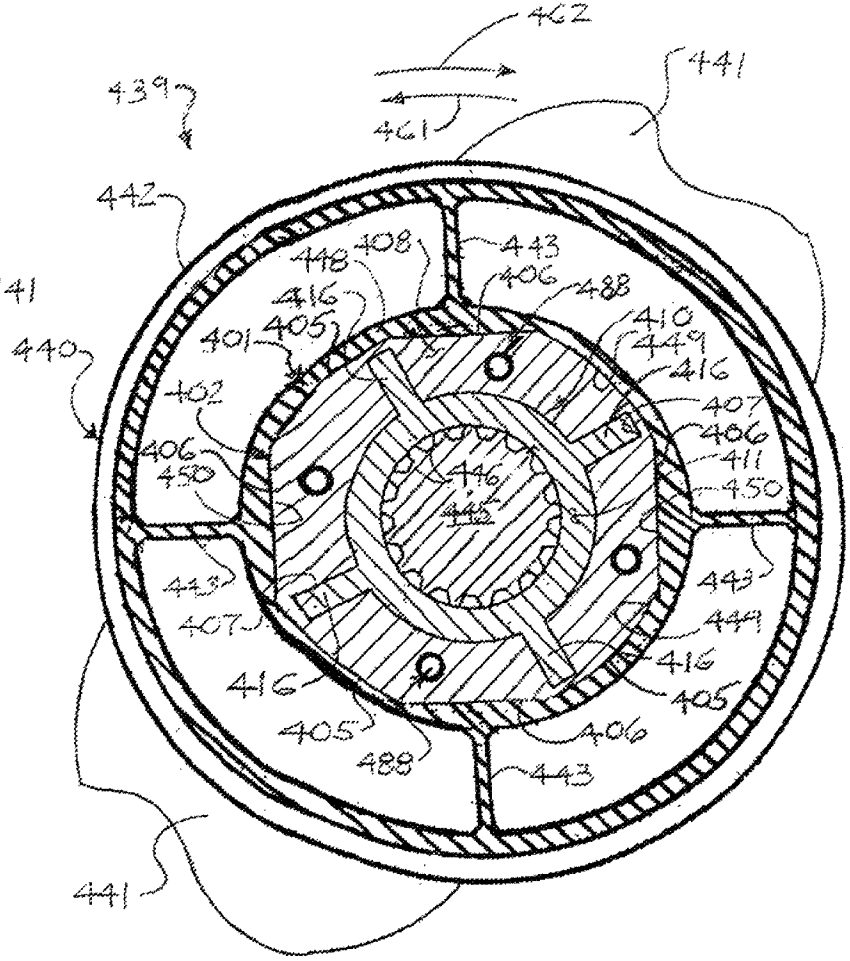
FIG. 36 is a cross-sectional view of the propeller hub of still another alternative illustrative embodiment of a marine propeller having a compression spring sleeve assembly with the drive core loaded in compression with the drive sleeve of the assembly.

Referring next to FIG. 36 of the drawings, another alternative illustrative embodiment of the marine propellers with compression spring sleeve assemblies is generally indicated by reference numeral 439. In the marine propeller assembly 439, elements which are analogous to the respective elements of the marine propeller assembly 39 that was heretofore described with respect to FIGS. 1-28 are designated by the same respective numerals in the 401-499 series in FIG. 36. The drive core 410 may be circumferentially offset with respect to the drive sleeve 402 of the compression spring sleeve assembly 401. Accordingly, each drive rib 416 may correspond positionally to a corresponding sleeve lug 405 of the drive sleeve 402, with the drive rib 416 off-center with respect to the sleeve lug 405 away from the forward rotational direction 461, as illustrated (for forward rotational bias), or toward the forward rotational direction 461 (for rearward rotational bias).

At least one axial deformation element 488 may extend through the drive sleeve body 408 of the drive sleeve 402. In some embodiments, at least one axial deformation element 488 may be disposed between adjacent drive ribs 416, as illustrated.

Application of the marine propeller with compression spring sleeve assembly 439 may be as was heretofore described with respect to the marine propeller assembly 39 in FIGS. 1-28. In the event that the propeller blades 441 of the marine propeller 440 strike a submerged obstacle in a water body, the offset configuration of the drive ribs 416 relative to the sleeve lugs 405 may impart offset rotational bias to the drive ribs 416 and non-equatorial loading of the drive ribs 416 for longer rotational movement of the drive ribs 416 in the forward rotational direction 461, as illustrated, or in the reverse rotational direction 462 (in embodiments in which the drive ribs 416 are offset in the opposite direction). The longer rotational movement of the drive ribs 416 may delay or optimize fracture or breakage of the drive ribs 416 as the drive ribs 416 absorb the strike force which may otherwise be borne by the propeller blades 441 and/or other components of the marine propeller 440 and/or the propeller drive shaft 445 and/or other components of the drivetrain. The axial deformation elements 488 may impart the desired deformation, spring return and/or shear properties which are optimum for a particular power output, propeller size and application.

Figure 37:
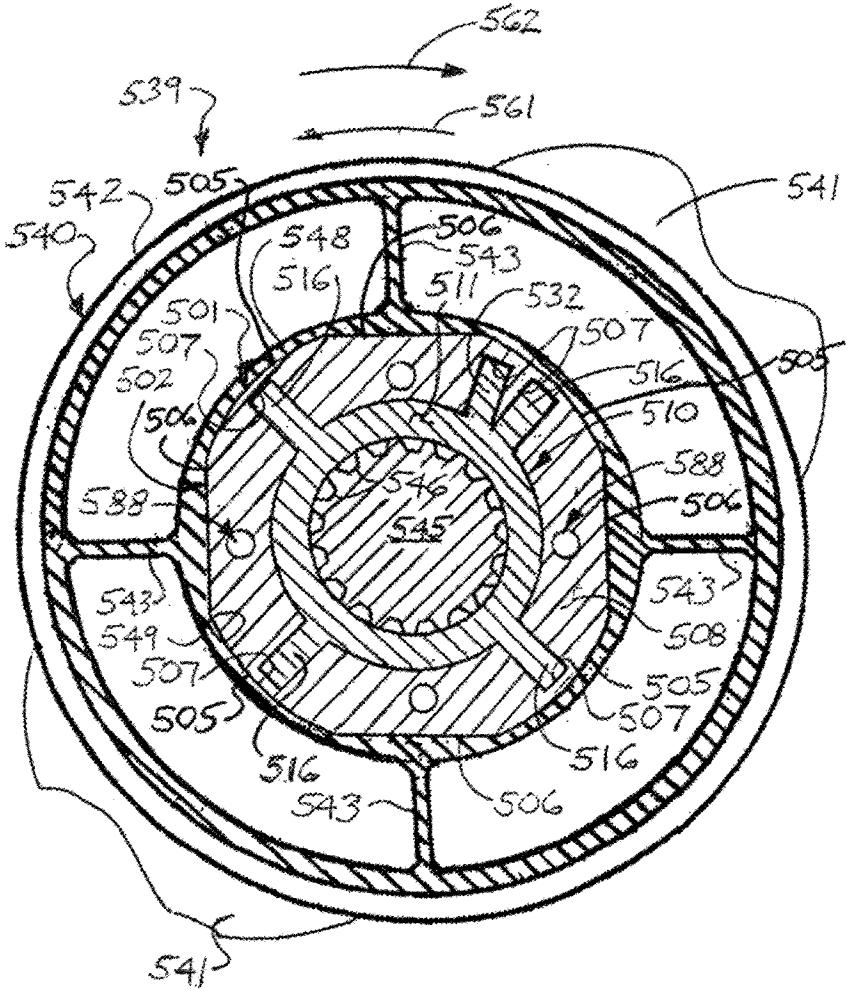
FIG. 37 is a cross-sectional view of the propeller hub of yet another alternative illustrative embodiment of a marine propeller having a compression spring sleeve assembly with a drive core having an angled sacrificial rib immediately adjacent to a drive rib in the forward rotational direction of the assembly.

Referring next to FIG. 37 of the drawings, another alternative illustrative embodiment of the marine propellers with compression spring sleeve assemblies is generally indicated by reference numeral 539. In the marine propeller assembly 539, elements which are analogous to the respective elements of the marine propeller assembly 39 that was heretofore described with respect to FIGS. 1-28 are designated by the same respective numerals in the 501-599 series in FIG. 37. At least one sacrificial rib 532 may extend from the drive core wall 511 of the drive core 510, typically immediately adjacent to and angling away from at least one drive rib 516 in the forward rotational direction 561, as illustrated. Alternatively, in some embodiments, the sacrificial rib 532 may angle away from the drive rib 516 in the reverse rotational direction 562. The drive rib 516 and adjacent sacrificial rib 532 may correspond positionally to a sleeve lug 505 of the drive sleeve 502, with the remaining drive ribs 516 typically corresponding positionally to the remaining sleeve lugs 505, respectively.

At least one axial deformation element 588 may extend through the drive sleeve body 508 of the drive sleeve 502. In some embodiments, at least one axial deformation element 588 may be disposed between the adjacent drive ribs 516 and between a drive rib 516 and the drive rib 516 paired with the sacrificial rib 532, as illustrated.

Application of the marine propeller assembly 539 may be as was heretofore described with respect to the marine propeller with compression spring sleeve assembly 1 in FIGS. 1-28. Accordingly, the drive ribs 516 and the sacrificial rib 532 may transmit the torsional force from the drive core 510 to the drive sleeve 502 of the compression spring sleeve assembly 501. In the event that the propeller blades 541 of the marine propeller 540 strike a submerged obstacle in a water body (in the forward rotational direction 561), the sacrificial rib 532 may fracture or break at the drive core wall 511 more readily than the drive ribs 516, thereby absorbing the strike force which may otherwise be borne by the propeller blades 541 and/or other components of the marine propeller 540, the propeller drive shaft 545 and/or other components of the drivetrain. The axial deformation elements 588 may impart the desired deformation, spring return and/or shear properties which are optimum for a particular power output, propeller size and application.

Figure 38:
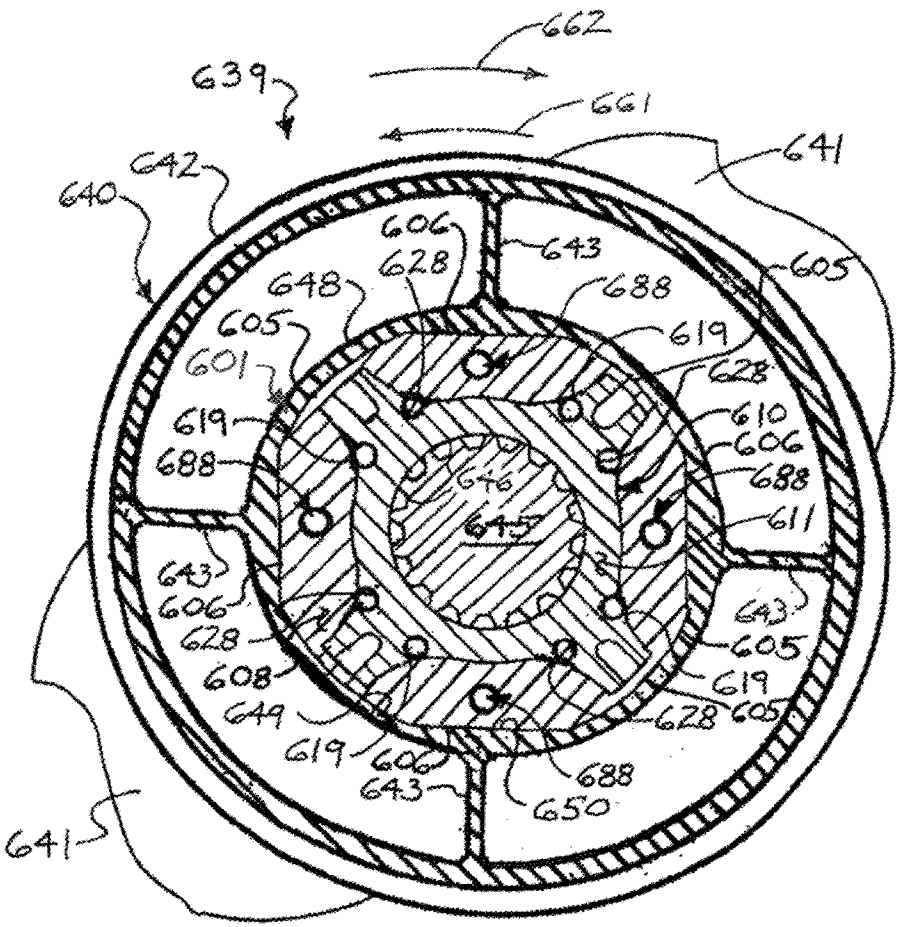
FIG. 38 is a cross-sectional view of the propeller hub of a still further alternative illustrative embodiment of a marine propeller having a compression spring sleeve assembly with rib shear channels at the rib base of each drive rib.
Figure 40:
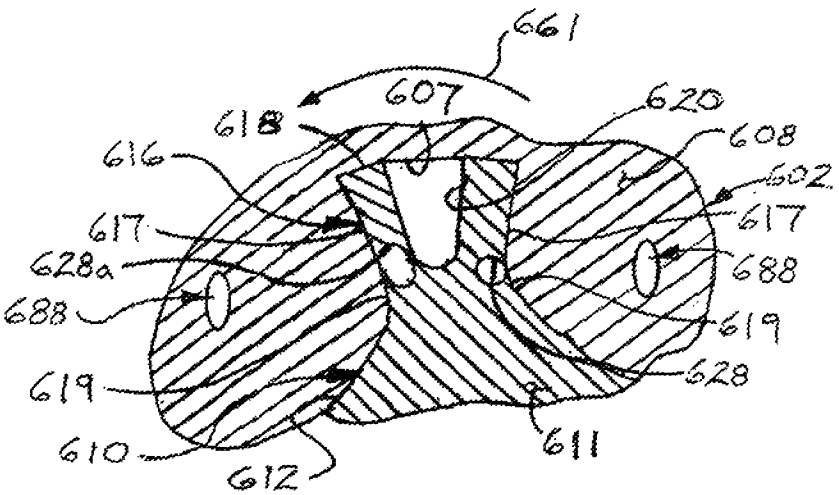
FIG. 40 is an enlarged sectional view of the drive rib, more particularly illustrating an alternative shear pattern of the drive rib at the rib shear channel with typical radial deformation of the axial deformation elements.
Figure 39:
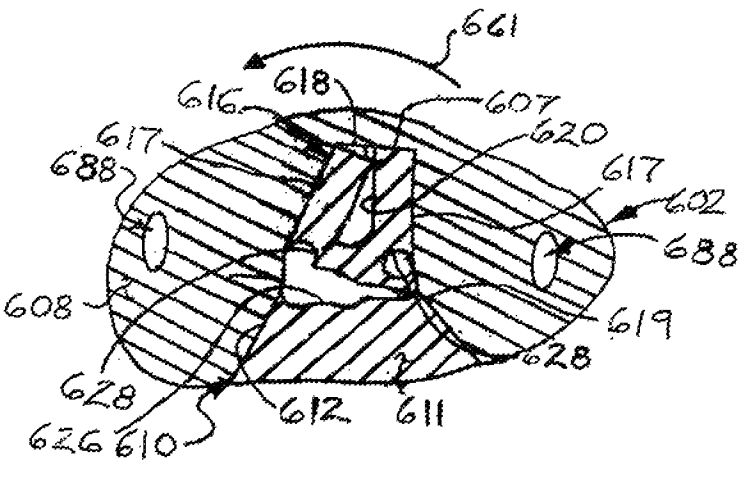
FIG. 39 is an enlarged sectional view of a drive rib of the compression spring sleeve assembly illustrated in FIG. 38, more particularly illustrating a typical shear pattern of the drive rib at one of the rib shear channels in the event that the marine propeller strikes a submerged obstacle (not illustrated) in typical application of the marine propellers with compression spring sleeve assemblies, and also illustrating typical radial deformation of the axial deformation elements in the drive sleeve body of the drive sleeve.

Referring next to FIG. 38-40 of the drawings, another alternative illustrative embodiment of the marine propellers with compression spring sleeve assemblies is generally indicated by reference numeral 639. In the marine propeller assembly 639, elements which are analogous to the respective elements of the marine propeller assembly 39 that was heretofore described with respect to FIGS. 1-28 are designated by the same respective numerals in the 601-699 series in FIG. 38. At least one rib shear channel 628 may extend into or through at least one drive rib 616 on the drive core 610 of the compression spring sleeve assembly 601. As illustrated in FIG. 38, in some embodiments, a rib shear channel 628 may be disposed at the rib base 619 on one or both sides of the drive rib 616. In other embodiments, each rib shear channel 628 may be disposed at any location or position along and adjacent to the length of each corresponding side rib surface 617. In some embodiments, each rib shear channel 628 may be as is described in U.S. application Ser. No. 17/850,349, now U.S. Pat. No. 11,760,460, which is hereby incorporated by reference herein in its entirety.

At least one axial deformation element 688 may extend through the drive sleeve body 608 of the drive sleeve 602. In some embodiments, at least one axial deformation element 688 may be disposed between the adjacent drive ribs 616 on the drive core 610, as illustrated.

In operation of the marine propeller assembly 639, the shear properties of the drive ribs 616 on the drive core 610 may impart shearing characteristics to the drive sleeve 602 for optimum driveline protection during propeller striking events, sudden gear changes and the like. In some applications in which the propeller blades 641 of the marine propeller 640 strike a submerged obstacle in the forward rotational direction 661 of the marine propeller 640, rotation of the marine propeller 640 may suddenly stop or substantially slow as the propeller drive shaft 645 continues to rotate at operational speed. Accordingly, one or more of the drive ribs 616 may partially or completely shear or shear at different rates, typically at one of the shear channels 628. For example and without limitation, as illustrated in FIG. 39, in some cases, a break line 626 may form at the leading rib shear channel 628 along the rib base 619, and the fractured portion of the drive rib 616 may break into the shear cavity 620. Alternatively, as illustrated in FIG. 40, the fractured portion of the drive rib 616 may break away from the shear cavity 620. The fractured drive rib or ribs 616 may thus absorb the strike force which may otherwise be borne by the propeller blades 641, other components of the marine propeller 640, the propeller drive shaft 645 and/or other components of the drivetrain, thus preventing or minimizing the likelihood of damaging these components. Engagement of the drive core 610 with the drive sleeve 602 at the fractured drive rib or ribs 616 may be attenuated or compromised. Typically, one or more of the drive ribs 616 may remain intact to continue rotational engagement between the propeller drive shaft 645 and the marine propeller 640 to ensure continued forward operation of the marine vehicle on the water body. The same effect may result in rotation of the marine propeller 640 in the reverse rotational direction 662, with the drive rib 616 typically fracturing at the trailing rib shear channel 628. In typical application, the drive ribs 616 may facilitate rotational absorption of about 5°-8° upon shearing of each. The axial deformation elements 688 may impart the desired deformation, spring return and/or shear properties which are optimum for a particular power output, propeller size and application.

Figure 41:
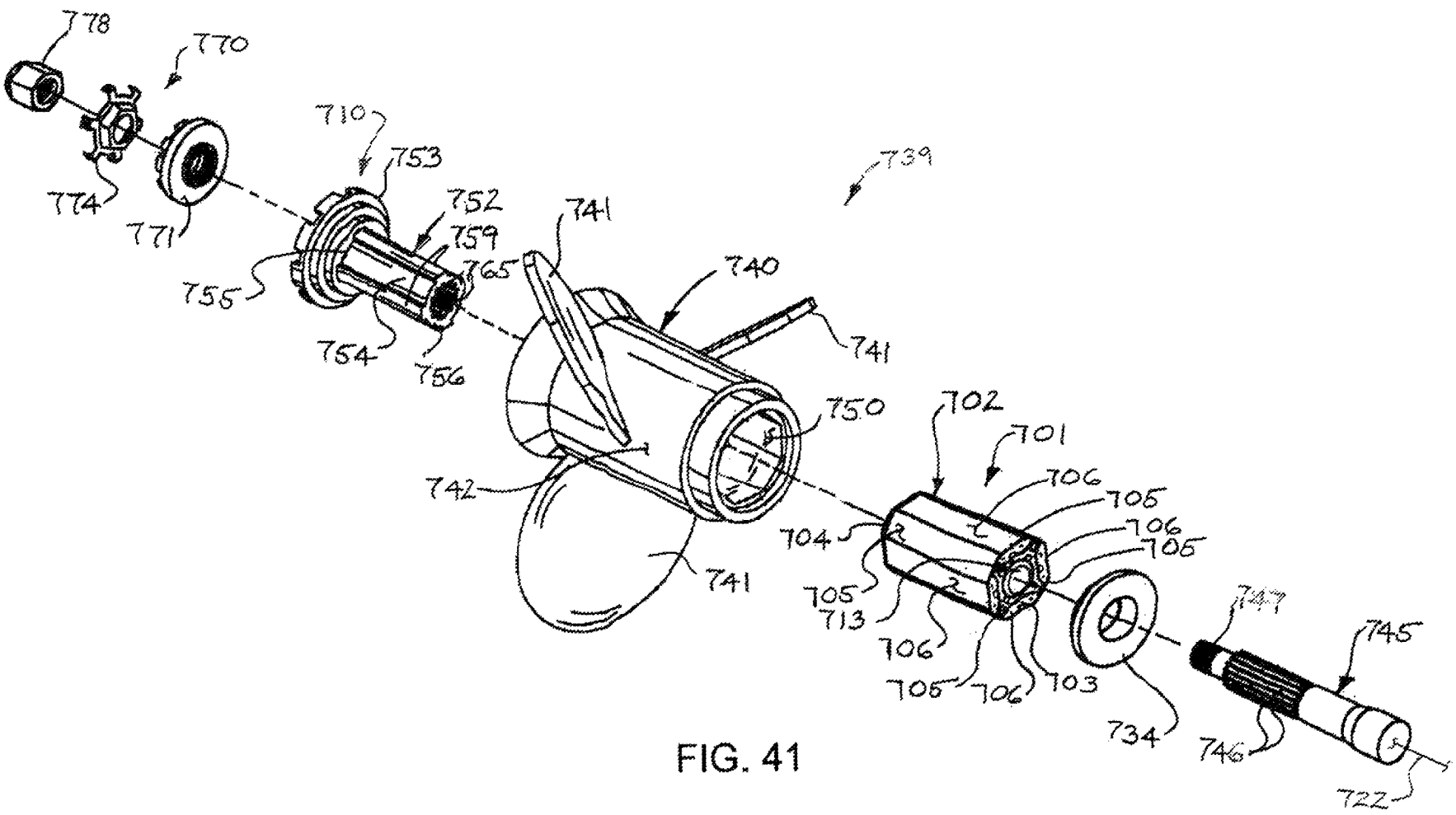
FIG. 41 is a front perspective view of another illustrative embodiment of the marine propellers with compression spring sleeve assemblies, in which the drive core of the assembly includes a drive adaptor.
Figure 43:
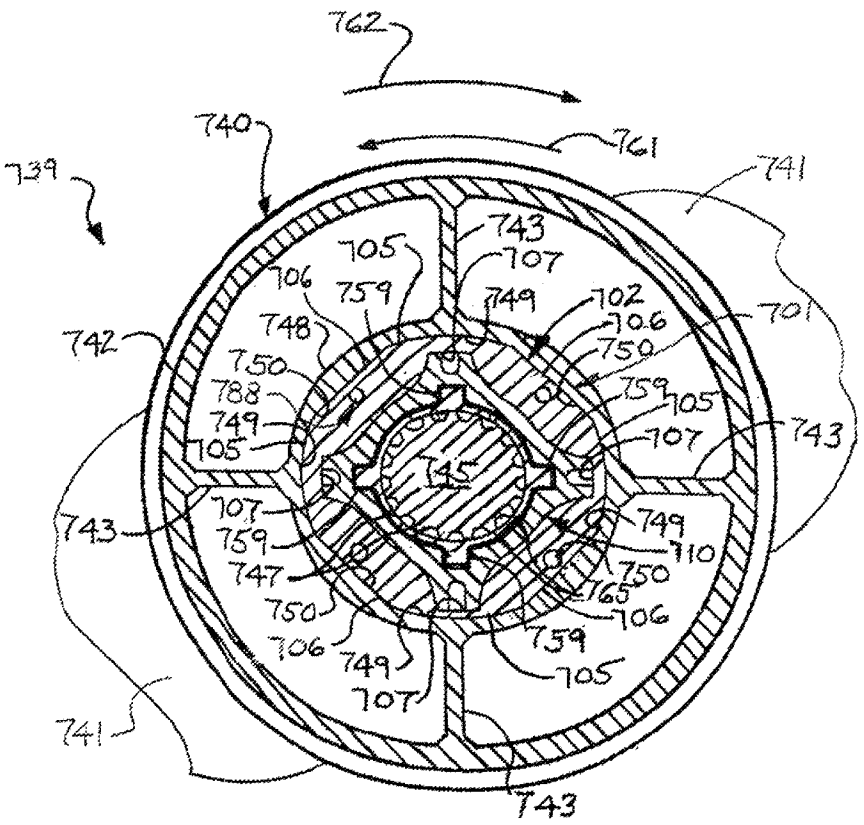
FIG. 43 is a cross-sectional view of the propeller hub of the illustrative marine propeller with compression spring sleeve assembly illustrated in FIG. 41.
Figure 42:
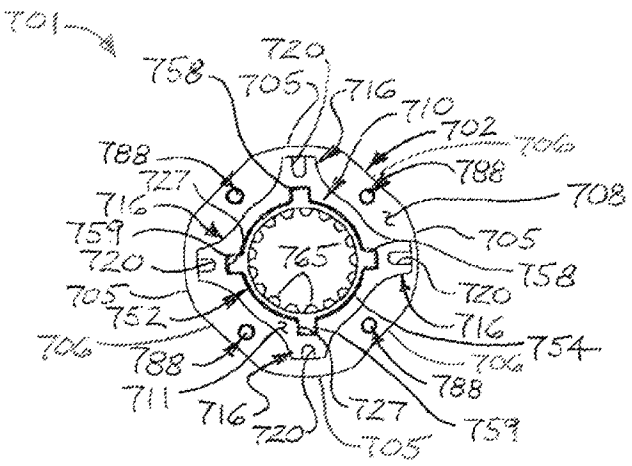
FIG. 42 is a front view of the compression spring sleeve assembly illustrated in FIG. 41.

Referring next to FIGS. 41-43 of the drawings, another alternative illustrative embodiment of the marine propellers with compression spring sleeve assemblies is generally indicated by reference numeral 739. In the marine propeller assembly 739, elements which are analogous to the respective elements of the marine propeller with compression spring sleeve assembly 39 that was heretofore described with respect to FIGS. 1-28 are designated by the same respective numerals in the 701-799 series in FIGS. 41-43. The marine propeller assembly 739 may be suitably configured to be drivingly engaged by a drive adaptor 752 which is drivingly engaged for rotation by the propeller drive shaft 745. The drive adaptor 752 may include an adaptor base 753. An elongated adaptor shaft 754 may extend from the adaptor base 753. The adaptor shaft 754 may have an aft shaft end 755 at the adaptor base 753 and a fore shaft end 756 opposite the aft shaft end 755.

Adaptor drive splines 765 may be provided in the interior of the adaptor shaft 754 of the drive adaptor 752. As illustrated in FIG. 43, in assembly of the marine propeller 740 on the propeller drive shaft 745, the interior adaptor drive splines 765 may mesh with the companion exterior drive shaft splines 746 on the propeller drive shaft 745. At least one, and typically, multiple adaptor lugs 759 may extend from and along the adaptor shaft 754.

As illustrated in FIG. 42, at least one, and typically, multiple lug cavities 727 may be provided in the drive core wall 711 of the drive core 710. Each lug cavity 727 may be suitably sized and configured to receive a corresponding adaptor lug 759 on the adaptor shaft 754 of the drive adaptor 752.

In rotation of the propeller drive shaft 745 in the forward rotational direction 761 (FIG. 43), the drive adaptor 752 transmits the forward torsional force from the propeller drive shaft 745 to the drive core 710 via the adaptor lugs 759. The drive core 710, in turn, transmits the torsional force to the drive sleeve 702 via the drive ribs 716, and the drive sleeve 702 transmits the torsional force to the propeller hub drive sleeve 748 typically via the sleeve lugs 705 and the sleeve flats 706. As the compression spring sleeve assembly 701 transfers the torsional drive force from the propeller drive shaft 745 to the propeller hub 742, the shearing characteristics of the drive ribs 716 may impart shear capability between those components to prevent or minimize damage to the propeller drive system during power surges, sudden gear changes and loads typically in the event that one of the propeller blades 741 of the rotating propeller 740 inadvertently strikes a submerged object (not illustrated). The axial deformation elements 788 in the drive sleeve 702 of the compression spring sleeve assembly 701 may impart the desired deformation, spring return and/or shear properties which are optimum for a particular power output, propeller size and application.

While the preferred embodiments of the invention have been described above, it will be recognized and understood that various modifications may be made in the invention and the appended claims are intended to cover all such modifications which may fall within the spirit and scope of the invention.

I claim:

1. A marine propeller for driving engagement by a propeller drive shaft, comprising:

a propeller hub having an axis of rotation; and a compression spring sleeve assembly disposed in the propeller hub, the compression spring sleeve assembly comprising:

a drive core comprising:

a drive core wall;

at least one drive rib extending from the drive core wall; and a shaft bore formed by the drive core wall, the shaft bore sized and configured to receive the propeller drive shaft for driving rotational engagement thereby:

a drive sleeve drivingly engaged for rotation by the drive core and drivingly engaging the propeller hub for rotation, the drive sleeve having a drive sleeve body with a fore sleeve end and an aft sleeve end; and at least one axial deformation element having at least one dually open-ended deformation passageway in the drive sleeve body of the drive sleeve, the deformation passageway having a fore passageway end at the fore sleeve end and an aft passageway end at the aft sleeve end of the drive sleeve, the at least one axial deformation element oriented parallel to the axis of rotation of the propeller hub and the deformation passageway fully encased by the drive sleeve body throughout a cross-section of the drive sleeve taken perpendicular to the axis of rotation of the propeller hub.

2. The marine propeller of claim 1 wherein the at least one axial deformation element comprises a plurality of axial deformation elements.

3. The marine propeller of claim 2 wherein the axial deformation elements are linked together in a selected pattern.

4. The marine propeller of claim 1 wherein the at least one deformation passageway of the at least one axial deformation element is continuous in length with ambient air filling the at least one deformation passageway.

5. The marine propeller of claim 1 wherein the at least one deformation passageway of the at least one deformation element has a triangular, square, rectangular, octagonal, hexagonal, oval, or teardrop shaped cross-section.

6. The marine propeller of claim 1 wherein the at least one drive rib comprises a plurality of drive ribs, and further comprising at least one riblet extending outwardly from the drive core wall of the drive core between adjacent ones of the plurality of drive ribs and at least one riblet cavity in the drive sleeve body of the drive sleeve, the at least one riblet inserting at least partially into the at least one riblet cavity.

7. The marine propeller of claim 6 wherein the at least one riblet extends completely into the at least one riblet cavity.

8. The marine propeller of claim 1 further comprising a sleeve/core interface between the drive core wall of the drive core and the drive sleeve body of the drive sleeve.

9. The marine propeller of claim 8 further comprising at least one interface layer disposed at the sleeve/core interface.

10. The marine propeller of claim 9 wherein the at least one interface layer comprises at least one adhesive material.

11. The marine propeller of claim 8 wherein the sleeve/core interface comprises a tension fit.

12. The marine propeller of claim 8 wherein the sleeve/core interface comprises a plurality of meshing boundary projections.

13. The marine propeller of claim 1 wherein the drive sleeve body of the drive sleeve comprises a matrix of elastomeric material and a plurality of reinforcing members extending throughout the matrix of elastomeric material, the plurality of reinforcing members having physical properties different from physical properties of the matrix of elastomeric material of the drive sleeve body.

14. The marine propeller of claim 1 wherein the drive core is circumferentially offset with respect to the drive sleeve of the compression spring sleeve assembly.

15. The marine propeller of claim 14 further comprising a plurality of sleeve lugs on the drive sleeve body of the drive sleeve and a plurality of lug slots in the propeller hub and receiving the plurality of sleeve lugs, respectively, wherein the at least one drive rib corresponds positionally to a corresponding one of the plurality of sleeve lugs and off-center with respect to the corresponding one of the plurality of sleeve lugs away from the forward rotational direction for forward rotational bias.

16. The marine propeller of claim 14 further comprising a plurality of sleeve lugs on the drive sleeve body of the drive sleeve and a plurality of lug slots in the propeller hub and receiving the plurality of sleeve lugs, respectively, wherein the at least one drive rib corresponds positionally to a corresponding one of the plurality of sleeve lugs and off-center with respect to the corresponding one of the plurality of sleeve lugs toward the forward rotational direction for rearward rotational bias.

17. A marine propeller for driving engagement by a propeller drive shaft, comprising:

a propeller hub having an axis of rotation; and a multi-sectioned compression spring sleeve assembly disposed in the propeller hub, the multi-sectioned compression spring sleeve assembly comprising a plurality of sleeve sections independently drivingly engaged by the propeller drive shaft, the plurality of sleeve sections of the drive sleeve each comprising:

a drive core comprising:

a drive core wall:

at least one drive rib extending from the drive core wall; and a shaft bore formed by the drive core wall, the shaft bore sized and configured to receive the propeller drive shaft for driving rotational engagement thereby:

a drive sleeve drivingly engaged for rotation by the drive core and drivingly engaging the propeller hub for rotation, the drive sleeve having a drive sleeve body with a fore sleeve end and an aft sleeve end; and at least one axial deformation element having at least one dually open-ended deformation passageway in the drive sleeve body of the drive sleeve, the deformation passageway having a fore passageway end at the fore sleeve end and an aft passageway end at the aft sleeve end of the drive sleeve, the at least one axial deformation element oriented parallel to the axis of rotation of the propeller hub and the deformation passageway fully encased by the drive sleeve body throughout a cross-section of the drive sleeve taken perpendicular to the axis of rotation of the propeller hub.

18. The marine propeller of claim 17 wherein the sleeve sections of the drive sleeve are oriented in substantially aligned or registering relationship to each other in the drive sleeve.

19. The marine propeller of claim 17 wherein the sleeve sections of the drive sleeve are oriented in offset relationship to each other in the drive sleeve.

20. The marine propeller of claim 17 wherein each of the plurality of sleeve sections is shaped in the form of an O-ring.

21. The marine propeller of claim 17 wherein the propeller hub comprises a propeller hub drive sleeve drivingly engaged for rotation by the plurality of sleeve sections, and further comprising at least one transfer lug notch extending radially into the drive sleeve body and at least one propeller torque transfer lug extending inwardly from the propeller hub drive sleeve of the propeller hub of the marine propeller, the propeller torque transfer lug engaging the at least one transfer lug notch to drivingly connect the marine propeller to the plurality of sleeve sections.

22. A marine propeller for driving engagement by a propeller drive shaft, comprising:

a propeller hub having an axis of rotation and a forward rotational direction and a rearward rotational direction about the axis of rotation; and a compression spring sleeve assembly disposed in the propeller hub, the compression spring sleeve assembly comprising:

a drive core comprising:

a drive core wall;

at least one drive rib extending from the drive core wall:

at least one sacrificial rib extending from the drive core wall of the drive core, the at least one sacrificial rib configured to fracture or break at the drive core wall more readily than the at least one drive rib responsive to pressure applied to the at least one sacrificial rib;

a shaft bore formed by the drive core wall, the shaft bore sized and configured to receive the propeller drive shaft for driving rotational engagement thereby:

a drive sleeve drivingly engaged for rotation by the drive core and drivingly engaging the propeller hub for rotation, the drive sleeve having a drive sleeve body with a fore sleeve end and an aft sleeve end and a plurality of rib slots in the drive sleeve body, the at least one drive rib and the at least one sacrificial rib engaging the plurality of rib slots, respectively; and at least one axial deformation element having at least one dually open-ended deformation passageway in the drive sleeve body of the drive sleeve, the deformation passageway having a fore passageway end at the fore sleeve end and an aft passageway end at the aft sleeve end of the drive sleeve, the at least one axial deformation element oriented parallel to the axis of rotation of the propeller bub and the deformation passageway fully encased by the drive sleeve body throughout a cross-section of the drive sleeve taken perpendicular to the axis of rotation of the propeller hub.

23. The marine propeller of claim 22 wherein the at least one sacrificial rib comprises a pair of sacrificial ribs extending from the drive core wall in spaced-apart relationship to each other.

24. The marine propeller of claim 23 wherein the sacrificial ribs angle away from each other.

25. The marine propeller of claim 22 further comprising a plurality of sleeve lugs on the drive sleeve body of the drive sleeve and a plurality of lug slots in the propeller hub and receiving the plurality of sleeve lugs, respectively, and wherein the at least one sacrificial rib corresponds positionally to one of the plurality of sleeve lugs.

26. The marine propeller of claim 22 wherein the at least one sacrificial rib extends from the drive core wall of the drive core immediately adjacent to and angling away from the at least one drive rib.

27. The marine propeller of claim 26 wherein the at least one sacrificial rib angles away from the at least one drive rib in the forward rotational direction of the propeller hub.

28. A marine propeller for driving engagement by a propeller drive shaft, comprising:

a propeller hub having an axis of rotation; and a compression spring sleeve assembly disposed in the propeller hub, the compression spring sleeve assembly comprising:

a drive core comprising:

a drive core wall:

at least one drive rib extending from the drive core wall;

a shaft bore formed by the drive core wall, the shaft bore sized and configured to receive the propeller drive shaft for driving rotational engagement thereby; and at least one rib shear channel in the at least one drive rib;

a drive sleeve drivingly engaged for rotation by the drive core and drivingly engaging the propeller hub for rotation, the drive sleeve having a drive sleeve body with a fore sleeve end and an aft sleeve end; and at least one axial deformation element having at least one dually open-ended deformation passageway in the drive sleeve body of the drive sleeve, the deformation passageway having a fore passageway end at the fore sleeve end and an aft passageway end at the aft sleeve end of the drive sleeve, the at least one axial deformation element oriented parallel to the axis of rotation of the propeller hub and the deformation passageway fully encased by the drive sleeve body throughout a cross-section of the drive sleeve taken perpendicular to the axis of rotation of the propeller hub.

29. The marine propeller of claim 28 wherein each drive rib of the drive core comprises a pair of side rib surfaces, an outer rib surface extending between the pair of side rib surfaces and a rib base extending from the pair of side rib surfaces, the rib base forming a junction between the at least one drive rib and the drive core wall, and the at least one rib shear channel is disposed at the rib base on at least one of the pair of side rib surfaces of the drive rib.

30. A marine propeller for driving engagement by a propeller drive shaft, comprising:

a propeller hub having an axis of rotation; and a compression spring sleeve assembly disposed in the propeller hub, the compression spring sleeve assembly comprising:

a drive adaptor sized and configured to receive the propeller drive shaft for driving rotational engagement thereby;

a drive core comprising:

a drive core wall;

at least one drive rib extending from the drive core wall; and a shaft bore formed by the drive core wall, the shaft bore sized and configured to receive the drive adaptor for driving rotational engagement thereby:

a drive sleeve drivingly engaged for rotation by the drive core and drivingly engaging the propeller hub for rotation, the drive sleeve having a drive sleeve body with a fore sleeve end and an aft sleeve end; and at least one axial deformation element having at least one dually open-ended deformation passageway in the drive sleeve body of the drive sleeve, the deformation passageway having a fore passageway end at the fore sleeve end and an aft passageway end at the aft sleeve end of the drive sleeve, the at least one axial deformation element oriented parallel to the axis of rotation of the propeller hub and the deformation passageway fully encased by the drive sleeve body throughout a cross-section of the drive sleeve taken perpendicular to the axis of rotation of the propeller hub.

31. The marine propeller of claim 30 wherein the drive adaptor comprises an adaptor base, an elongated adaptor shaft extending from the adaptor base and at least one adaptor lug extending from and along the adaptor shaft, and further comprising at least one lug cavity in the drive core wall of the drive core, the at least one lug cavity sized and configured to receive the at least one adaptor lug on the adaptor shaft of the drive adaptor.

* * * * *